US010696042B2

(12) United States Patent
Chassot et al.

(10) Patent No.: US 10,696,042 B2
(45) Date of Patent: Jun. 30, 2020

(54) INKING SYSTEM FOR INKING AN INTAGLIO PRINTING CYLINDER OF AN INTAGLIO PRINTING PRESS, INTAGLIO PRINTING PRESS COMPRISING THE SAME, AND PROCESS OF INKING SUCH AN INTAGLIO PRINTING CYLINDER

(71) Applicant: KBA-NOTASYS SA, Lausanne (CH)

(72) Inventors: Daniel Chassot, Bienne (CH); Alain Würsch, La Tour-de-Peilz (CH); Ana Dimitrijevic, Lausanne (CH); Johannes Schaede, Würzburg (DE)

(73) Assignee: KBA-NOTASYS SA, Lausannne (CH)

( * ) Notice: Subject to any disclaimer, the term of this patent is extended or adjusted under 35 U.S.C. 154(b) by 0 days.

(21) Appl. No.: 16/498,911

(22) PCT Filed: Mar. 12, 2018

(86) PCT No.: PCT/EP2018/056052
§ 371 (c)(1),
(2) Date: Sep. 27, 2019

(87) PCT Pub. No.: WO2018/202344
PCT Pub. Date: Nov. 8, 2018

(65) Prior Publication Data

US 2020/0114642 A1 Apr. 16, 2020

(30) Foreign Application Priority Data

May 4, 2017 (EP) ..... 17169509

(51) Int. Cl.
*B41F 31/04* (2006.01)
*B41F 9/06* (2006.01)
*B41F 31/26* (2006.01)

(52) U.S. Cl.
CPC ..... *B41F 31/04* (2013.01); *B41F 9/063* (2013.01); *B41F 9/065* (2013.01); *B41F 31/26* (2013.01)

(58) Field of Classification Search
CPC ..... B41F 31/04
(Continued)

(56) References Cited

U.S. PATENT DOCUMENTS 4,516,496 A 5/1985 Giori
5,062,359 A * 11/1991 Giori ..... B41F 9/02 101/152

(Continued)

FOREIGN PATENT DOCUMENTS

CH 685380 6/1995
EP 0 176 702 4/1986

(Continued)

OTHER PUBLICATIONS

International Search Report and Written Opinion of the ISA for PCT/EP2018/056052 dated Jun. 18, 2018, 13 pages.

*Primary Examiner* — Anthony H Nguyen
(74) *Attorney, Agent, or Firm* — Nixon & Vanderhye P.C.

(57) ABSTRACT

An inking system for inking an intaglio printing cylinder of an intaglio printing press is designed to perform a selective transfer of ink to one or more intaglio printing mediums by way of a selective inking cylinder provided in at least one device. The selective inking cylinder carries a selective inking plate that receives ink supplied by an associated inking unit. The selective inking plate comprises a coating that is selectively structured to exhibit ink-repellent portions and perform selective transfer of ink at locations corresponding to engraved areas of the one or more intaglio printing mediums that are to be inked with the ink supplied by the associated inking unit. The selective transfer of ink is performed indirectly from the selective inking cylinder to (Continued)

the one or more intaglio printing mediums via an ink collecting cylinder and/or via a chablon cylinder carrying a chablon plate.

27 Claims, 13 Drawing Sheets

(58) Field of Classification Search
USPC ..... 101/350.1
See application file for complete search history.

(56) References Cited

U.S. PATENT DOCUMENTS 5,701,815 A * 12/1997 Bocko ..... B41F 17/00 101/151
2010/0195894 A1* 8/2010 Lohweg ..... G07D 7/2016 382/135
2011/0197777 A1* 8/2011 Osterberg ..... B41F 7/24 101/350.1
2012/0312179 A1* 12/2012 Scheade ..... B41F 31/004 101/153
2015/0075398 A1* 3/2015 Kamoda ..... B41L 19/00 101/350.1
2016/0009075 A1* 1/2016 Lefebvre ..... B41M 1/10 283/72
2016/0185100 A1* 6/2016 Chassot ..... B41F 9/021 428/195.1

FOREIGN PATENT DOCUMENTS

| | | |
|---|---|---|
| EP | 0 406 157 | 1/1991 |
| EP | 0 415 881 | 3/1991 |
| EP | 0 563 007 | 9/1993 |
| EP | 0 873 866 | 10/1998 |
| GB | 987102 | 3/1965 |
| WO | 97/36813 | 10/1997 |
| WO | 97/37329 | 10/1997 |
| WO | 03/047862 | 6/2003 |
| WO | 03/070465 | 8/2003 |
| WO | 2004/026580 | 4/2004 |
| WO | 2004/069538 | 8/2004 |
| WO | 2005/077656 | 8/2005 |
| WO | 2007/116353 | 10/2007 |
| WO | 2008/146193 | 12/2008 |
| WO | 2011/077348 | 6/2011 |
| WO | 2011/077350 | 6/2011 |
| WO | 2011/077351 | 6/2011 |
| WO | 2013/132471 | 9/2013 |
| WO | 2013/153519 | 10/2013 |
| WO | 2013/160853 | 10/2013 |
| WO | 2014/131479 | 9/2014 |
| WO | 2016/042482 | 3/2016 |

* cited by examiner

INKING SYSTEM FOR INKING AN INTAGLIO PRINTING CYLINDER OF AN INTAGLIO PRINTING PRESS, INTAGLIO PRINTING PRESS COMPRISING THE SAME, AND PROCESS OF INKING SUCH AN INTAGLIO PRINTING CYLINDER

This applicaton is the U.S. national phase of Internvtional Application No. PCT/EP2018/056052 filed Mar. 12, 2018 which designated the U.S. and claims priority to EP Patent Applicaton No. 17169509.1 filed May 4, 2017, the entire contents of each of which are hereby incorporated by reference.

TECHNICAL FIELD

The present invention generally relates to systems and methods of inking of an intaglio printing cylinder of an intaglio printing press, which intaglio printing cylinder carries one or more intaglio printing mediums. More precisely, the invention relates to various embodiments of an inking system for inking such an intaglio printing cylinder, an intaglio printing press comprising such an inking system and a process of inking such an intaglio printing cylinder.

BACKGROUND OF THE INVENTION

International Publication No. WO 2014/131479 A1 discloses an inking system for inking an intaglio printing cylinder of an intaglio printing press, which intaglio printing cylinder carries one or more intaglio printing mediums, the inking system comprising an ink collecting cylinder designed to cooperate with the intaglio printing cylinder and to collect ink patterns from a plurality of inking devices that are distributed about a portion of the circumference of the ink collecting cylinder, wherein at least one of the inking devices, preferably each inking device, comprises a selective inking cylinder cooperating with the ink collecting cylinder, wherein the selective inking plate comprises a coating that is selectively structured to exhibit ink-repellent portions and perform selective transfer of ink at locations corresponding to engraved areas of the one or more intaglio printing mediums that are to be inked with the ink supplied by the associated inking unit.

Publication U.S. Pat. No. 4,516,496 A discloses an inking system for inking an intaglio printing cylinder, comprising an ink collecting cylinder designed to collect ink patterns from a plurality of inking devices each having a selective inking cylinder that are distributed about a portion of the circumference of the ink collecting cylinder.

Furthermore, intaglio printing presses are already known in the art, for instance from Swiss Patent No. CH 685 380 A5, European Patent Publications Nos. EP 0 406 157 A1, EP 0 415 881 A2, EP 0 563 007 A1, EP 0 873 866 A1, and International Publications Nos. WO 03/047862 A1, WO 2005/077656 A1, WO 2008/146193 A1, WO 2011/077348 A1, WO 2011/077350 A1, WO 2011/077351 A1, WO 2013/153519 A2, all assigned to the instant Applicant.

In the above-listed intaglio printing presses, inking of the plate cylinder carrying the intaglio printing plate(s) (which plate cylinder acts as intaglio printing cylinder) is typically carried out by means of a plurality of inking devices that cooperate either directly with the plate cylinder or indirectly, via an ink collecting cylinder (also referred to in the art as "Orlof" cylinder) that collects ink from multiple inking devices. Each such inking devices comprises a chablon cylinder that cooperates either with the plate cylinder or the ink collecting cylinder (if present), which chablon cylinder carries a chablon plate comprising relief portions corresponding to engraved areas of the intaglio printing plates that are to be inked with a given ink supplied by an associated inking unit placed upstream of the chablon cylinder.

FIGS. 1*a* and 1*b* schematically illustrate a known intaglio printing press as for instance disclosed in International Publication No. WO 2013/153519 A2, which printing press is generally designated by reference numeral 1.

More precisely, FIG. 1*a* shows a sheet-fed intaglio printing press 1 comprising a sheet feeder 2 for feeding sheets to be printed, an intaglio printing unit 3 for printing the sheets, and a sheet delivery unit 4 for collecting the freshly-printed sheets. The intaglio printing unit 3 includes an impression cylinder 7, a plate cylinder 8 acting as intaglio printing cylinder (in this example, the plate cylinder 8 is a three-segment plate cylinder carrying three intaglio printing plates 8*a*, 8*b*, 8*c* ), an inking system comprising an ink collecting cylinder, or Orlof cylinder, 9 (here a three-segment blanket cylinder carrying a corresponding number of blankets) for inking the surface of the intaglio printing plates 8*a*, 8*b*, 8*c* carried by the plate cylinder 8 and an ink wiping system 10 for wiping the inked surface of the intaglio printing plates 8*a*, 8*b*, 8*c* carried by the plate cylinder 8 prior to printing of the sheets.

The sheets are fed from the sheet feeder 2 onto a feeder table and then onto the impression cylinder 7. The sheets are then carried by the impression cylinder 7 to the printing nip between the impression cylinder 7 and the plate cylinder 8 where intaglio printing is performed. Once printed, the sheets are transferred away from the impression cylinder 7 for conveyance by a sheet transporting system 11 in order to be delivered to the delivery unit 4. The sheet transporting system 11 conventionally comprises a sheet conveyor system with a pair of endless chains driving a plurality of spaced-apart gripper bars for holding a leading edge of the sheets (the freshly-printed side of the sheets being oriented downwards on their way to the delivery unit 4), sheets being transferred in succession to a corresponding one of the gripper bars.

During their transport to the sheet delivery unit 4, the freshly printed sheets are preferably inspected by an optical inspection system 5. In the illustrated example, the optical inspection system 5 is advantageously an inspection system as disclosed in International Publication No. WO 2011/161656 A1 (which publication is incorporated herein by reference in its entirety), which inspection system 5 comprises a transfer mechanism and an inspection drum located at the transfer section between the impression cylinder 7 and chain wheels of the sheet transporting system 11. The optical inspection system 5 could alternatively be an inspection system placed along the path of the sheet transporting system 11 as described in International Publications Nos. WO 97/36813 A1, WO 97/37329 A1, and WO 03/070465 A1. Such inspection systems are in particular marketed by the Applicant under the product designation NotaSave®.

Before delivery, the printed sheets are preferably transported in front of a drying or curing unit 6 disposed after the inspection system 5 along the transport path of the sheet transporting system 11. Drying or curing could possibly be performed prior to the optical inspection of the sheets.

FIG. 1*b* is a schematic view of the intaglio printing unit 3 of the intaglio printing press 1 of FIG. 1*a*. As already mentioned, the intaglio printing unit 3 basically includes the impression cylinder 7, the plate cylinder 8 with its intaglio printing plates 8*a*, 8*b*, 8*c*, the inking system with its ink collecting cylinder 9, and the ink wiping system 10.

The inking system comprises in this example five inking devices 90, all of which cooperate with the ink collecting cylinder 9 that contacts the plate cylinder 8. It will be understood that the illustrated inking system is adapted for indirect inking of the plate cylinder 8, i.e. inking of the intaglio printing plates 8*a*, 8*b*, 8*c* via the ink collecting cylinder 9. The inking devices 90 each include an ink duct comprising a duct roller 91 cooperating in this example with a pair of ink application rollers 92. Each pair of ink application rollers 92 in turn inks a corresponding chablon cylinder 93 which is in contact with the ink collecting cylinder 9. As is usual in the art, each chablon cylinder 93 carries a chablon plate 93a (also referred to as a "poly-chablon plate" or "stencil plate") that is structured so as to exhibit relief portions 93A corresponding to the areas of the intaglio printing plates 8*a*, 8*b*, 8*c* intended to receive the inks in the corresponding colours supplied by the respective inking units 91/92 (see also the photographic illustration of FIG. 2). In essence, each chablon plate 93*a* is functionally equivalent to a letterpress plate, with the relief portions 93A acting as ink transfer portions.

As shown in FIGS. 1*a*, 1*b* and 2, the impression cylinder 7 and plate cylinder 8 are both supported in a stationary (main) frame 50 of the printing press 1. The inking devices 90 (including the duct roller 91 and ink application rollers 92) are supported in a mobile inking carriage 52, while the ink collecting cylinder 9 and chablon cylinders 93 are supported in an intermediate carriage 51 located between the inking carriage 52 and the stationary frame 50. Both the inking carriage 51 and the intermediate carriage 52 are advantageously suspended under supporting rails. In that respect, the photographic illustration of FIG. 2 shows three of the chablon cylinders 93 mounted in the intermediate carriage 51, with the inking carriage 52 (not visible in FIG. 2) being moved to a retracted position (as schematically illustrated by dashed lines in FIG. 1*a*).

The ink wiping system 10, on the other hand, typically comprises a wiping tank, a wiping roller assembly supported on and partly located in the wiping tank and contacting the plate cylinder 8, cleaning means for removing wiped ink residues from the surface of the wiping roller assembly using a wiping solution that is sprayed or otherwise applied onto the surface of the wiping roller assembly, and a drying blade contacting the surface of the wiping roller assembly for removing wiping solution residues from the surface of the wiping roller assembly. A particularly suitable solution for the ink wiping system 10 is disclosed in International Publications Nos. WO 2007/116353 A1 and WO 2013/132471 A1, which publications are incorporated herein by reference in their entirety.

A limitation with the known inking system that make use of chablon cylinders, as for instance illustrated in FIGS. 1*a*, 1*b* and 2, resides in the fact that the chablon plates 93*a* typically comprise an outer layer acting as ink transfer layer, which is made of a relatively soft and resilient material (such as a light sensitive photopolymer layer bonded to a steel base plate) that is structured to form the relief portions 93A that cover the relevant areas of the intaglio printing plates to be inked with the desired ink. Such chablon plates 93*a* are for instance marketed by company Flint Group under the product designation nyloprint® (in particular nyloprint® WS 230 S or WS 230 Digital stencil plates) and are typically structured by exposure through a laser-ablatable mask (LAM) layer that has been removed (namely ablated by laser) in the portions that are to remain as the desired relief portions 93A after exposure to light and subsequent washing of the unexposed photopolymer layer. The resulting relief portions 93A are typically rather simple and basically exhibit a continuous surface where ink is to be transferred as illustrated for instance in the photographic illustration of FIG. 2. Due to the relatively soft and resilient nature of the material forming the relief portions 93A, it is typically not possible to structure the relief portions 93A of the chablon plates 93*a* so as to exhibit very fine structures. The resolution of the chablon plates is therefore limited and the relief portions 93A typically restricted to rather crudely-defined surfaces that only vaguely reflect the engraved areas to be inked on the intaglio printing plates.

This further implies that the amount of ink that is transferred by each chablon cylinder is relatively substantial, which leads to a high consumption of ink as all excess ink that is deposited outside of the engraved areas of the intaglio printing plates is wiped off by the wiping system and ends up as waste.

Solutions have been proposed to reduce the consumption of ink by compensating the elongation of the intaglio printing plates, thereby allowing the use of chablon plates with smaller relief portions that more precisely match the engraved areas of the intaglio printing plates to be inked (see e.g. International Publications Nos. WO 2004/069538 A2 and WO 2013/160853 A2), but improvements are still required and welcome.

British Patent No. GB 987,102 discloses an old concept of an intaglio printing press where the plate cylinder acting as intaglio printing cylinder is inked by means of multiple inking devices, each comprising an ink fountain supplying ink to a duct roller, which transfers the ink to an inking roller cooperating with the plate cylinder via an intermediate transfer roller and a so-called "partial-image cylinder" which rotates in contact with the intermediate ink transfer roller and the inking roller. In contrast to the previously mentioned solutions, the inking roller (which likewise consists of or is coated with a resilient material) is solid and has a continuous surface, i.e. does not exhibit any relief portion, whereas the partial-image cylinder is made of a hard (e.g. metallic) material that is structured to exhibit relief portions precisely matching the delineation of the engraved areas of the intaglio printing plates that are to be inked in the relevant ink.

By way of alternative, GB 987,102 also contemplates to employ ink-repelling means of the type used for lithographic printing processes as a way to carry out the selective transfer of ink by means of the partial-image cylinder.

A problem with the solution disclosed in British Patent No. GB 987,102 however resides in the fact that the inking rollers are in continuous rolling contact with the plate cylinder and therefore take up ink deposited by the other inking devices, potentially leading to ink contamination and print quality issues.

An improved solution is thus required.

SUMMARY OF THE INVENTION

A general aim of the invention is therefore to provide an improved solution for inking an intaglio printing cylinder of an intaglio printing press.

A further aim of the invention is to provide such a solution that achieves a more accurate inking of the intaglio printing mediums carried by the intaglio printing cylinder and, therefore, reduces ink consumption.

Yet another aim of the invention is to provide such a solution that does not compromise accessibility to and maintenance of the relevant components of the inking system.

These aims are achieved thanks to the solutions defined in the claims.

In accordance with a first variant of the invention, there is provided an inking system for inking an intaglio printing cylinder of an intaglio printing press, which intaglio printing cylinder carries one or more intaglio printing mediums, the inking system comprising an ink collecting cylinder designed to cooperate with the intaglio printing cylinder and to collect ink patterns from a plurality of inking devices that are distributed about a portion of the circumference of the ink collecting cylinder, wherein at least one of the inking devices, preferably each inking device, comprises a selective inking cylinder cooperating with the ink collecting cylinder and carrying a selective inking plate, which selective inking plate receives ink supplied by an associated inking unit. This selective inking plate comprises a coating that is selectively structured to exhibit ink-repellent portions and perform selective transfer of ink at locations corresponding to engraved areas of the one or more intaglio printing mediums that are to be inked with the ink supplied by the associated inking unit.

In accordance with a second variant of the invention, there is provided an inking system for inking an intaglio printing cylinder of an intaglio printing press, which intaglio printing cylinder carries one or more intaglio printing mediums, the inking system comprising a plurality of inking devices that are distributed about a portion of the circumference of the intaglio printing cylinder, each inking device comprising a chablon cylinder cooperating with the intaglio printing cylinder and carrying a chablon plate, which chablon plate, receives ink supplied by an associated inking unit. Each chablon plate is a relief plate comprising relief portions corresponding to engraved areas of the one or more intaglio printing mediums that are to be inked with the ink supplied by the associated inking unit. Furthermore, at least one of the inking devices, preferably each inking device, further comprises a selective inking cylinder interposed between the chablon cylinder and the associated inking unit, which selective inking cylinder carries a selective inking plate comprising a coating that is selectively structured to exhibit ink-repellent portions and perform selective transfer of ink at locations corresponding to engraved areas of the one or more intaglio printing mediums that are to be inked with the ink supplied by the associated inking unit.

In accordance with a third variant of the invention, there is provided an inking system for inking an intaglio printing cylinder of an intaglio printing press, which intaglio printing cylinder carries one or more intaglio printing mediums, the inking system comprising an ink collecting cylinder designed to cooperate with the intaglio printing cylinder and to collect ink patterns from a plurality of inking devices that are distributed about a portion of the circumference of the ink collecting cylinder, each inking device comprising a chablon cylinder cooperating with the ink collecting cylinder and carrying a chablon plate, which chablon plate receives ink supplied by an associated inking unit. Each chablon plate (99*a*) is a relief plate comprising relief portions corresponding to engraved areas of the one or more intaglio printing mediums that are to be inked with the ink supplied by the associated inking unit. Furthermore, at least one of the inking devices, preferably each inking device, further comprises a selective inking cylinder interposed between the chablon cylinder and the associated inking unit, which selective inking cylinder carries a selective inking plate comprising a coating that is selectively structured to exhibit ink-repellent portions and perform selective transfer of ink at locations corresponding to engraved areas of the one or more intaglio printing mediums that are to be inked with the ink supplied by the associated inking unit.

In accordance with the invention, it will therefore be appreciated that the selective transfer of ink is performed indirectly from the selective inking cylinder to the one or more intaglio printing mediums via an ink collecting cylinder and/or via a chablon cylinder carrying a chablon plate comprising relief portions corresponding to engraved areas of the one or more intaglio printing mediums that are to be inked with the ink supplied by the associated inking unit.

In all instances, no contamination of ink occurs thanks to the use of the selective inking plate and, if present, of the chablon plate. Furthermore, the selective inking plate guarantees optimal accuracy of the inking as the coating can be structured so as to accurately reflect the relevant engraved areas on the intaglio printing plate(s). This leads in turn to a reduced ink consumption.

The aforementioned coating is preferably an ink-repellent coating that is formed on top of an ink-accepting layer or base, which ink-repellent coating is selectively removed, especially laser-ablated, to expose the underlying ink-accepting layer or base at the locations where ink is to be selectively transferred. Alternatively, the coating could be an ink-accepting coating formed on top of an ink-repellent layer or base, which ink-accepting coating is selectively removed, especially laser-ablated, to expose the underlying ink-repellent layer or base and form the ink-repellent portions outside of the locations where ink is to be selectively transferred. The selective inking plate is a plate exhibiting substantially no relief, which is achievable thanks to a coating exhibiting a thickness of the order of a few microns only.

In the context of the first and second variants of the invention, the inking unit supplying ink to the selective inking plate could advantageously be designed as a short inking unit comprising an ink duct with a duct roller inking the selective inking plate via a pair of ink application rollers. In the context of the third variant of the invention, the inking unit supplying ink to the selective inking plate could likewise be designed as a short inking unit comprising an ink duct with a duct roller inking the selective inking plate. In this latter case, the duct roller could furthermore be provided with engravings corresponding to engraved areas of the one or more intaglio printing mediums that are to be inked with the ink supplied by the inking unit.

Alternatively, in accordance with another embodiment of the invention, the inking unit supplying ink to the selective inking plate could be designed as a long inking unit comprising an ink duct with a duct roller inking the selective inking plate via a plurality of ink transfer rollers. In this context, each inking unit could further comprises a vibrator roller interposed between the duct roller and a first one of the ink transfer rollers.

By way of preference, the aforementioned ink ducts could each be designed as an ink fountain with an ink fountain blade cooperating with the duct roller.

There is also provided an intaglio printing press comprising the aforementioned inking system, as well as various embodiments where the inking units, selective inking cylinder(s) and chablon cylinder(s), if present, are located and supported in one or more carriages that can each be retracted during maintenance operations, which facilitates access to the relevant parts and components of the inking system.

There is further provided a process of inking an intaglio printing cylinder of an intaglio printing press, which intaglio printing cylinder carries one or more intaglio printing mediums, the process including inking the one or more intaglio printing mediums by means of a plurality of inking devices, wherein the process includes a selective transfer of ink to the one or more intaglio printing mediums by means of a selective inking cylinder provided in at least one of the inking devices, preferably in each of the inking devices, which selective inking cylinder carries a selective inking plate receiving ink supplied by an associated inking unit. According to this process, the selective inking plate likewise comprises a coating that is selectively structured to exhibit ink-repellent portions and perform selective transfer of ink at locations corresponding to engraved areas of the one or more intaglio printing mediums that are to be inked with the ink supplied by the associated inking unit. This selective transfer of ink is once again performed indirectly from the selective inking cylinder to the one or more intaglio printing mediums via an ink collecting cylinder and/or via a chablon cylinder carrying a chablon plate comprising relief portions corresponding to engraved areas of the one or more intaglio printing mediums that are to be inked with the ink supplied by the associated inking unit.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of an application to a sheet-fed intaglio printing press as used for the production of banknotes and like security documents. It should however be appreciated that the invention is generally applicable to any intaglio printing press comprising an intaglio printing cylinder carrying one or more intaglio printing mediums on its circumference. This includes in particular web-fed intaglio printing presses, as for instance disclosed in European Patent Publication No. EP 0 415 881 A2 or International Publication No. WO 2004/026580 A1.

Within the scope of the present invention, the expression "intaglio printing cylinder" designates any cylinder carrying one or more intaglio printing mediums, which intaglio printing mediums are each provided with engraved areas (or "intaglio patterns") that one wishes to supply with ink. This in particular includes cylinders adapted to receive a removable intaglio printing sleeve or, as is now more common in the art, a plate cylinder carrying one or more intaglio printing plates. In the following description, it will be assumed for the sake of illustration that the intaglio printing cylinder is a plate cylinder carrying several (namely three) intaglio printing plates on its circumference.

Similarly, the expression "chablon cylinder" is to be understood as designating a cylinder carrying a chablon plate with raised portions whose purpose is to selectively transfer ink patterns to the circumference of a downstream-located ink-receiving cylinder.

Furthermore, the expression "ink collecting cylinder" designates within the scope of the present invention a cylinder whose purpose is to collect inks from multiple inking devices before transferring the resulting multicolour pattern of inks onto the intaglio printing cylinder. In the art of intaglio printing, the expression "Orlof cylinder" is also typically used as an equivalent to the expression "ink collecting cylinder".

Lastly, the expression "selective inking cylinder" is to be understood as designating a cylinder carrying a selective inking plate in accordance with the present invention, which "selective inking cylinder" is understood to be distinct from the aforementioned "chablon cylinder".

Figure 2:
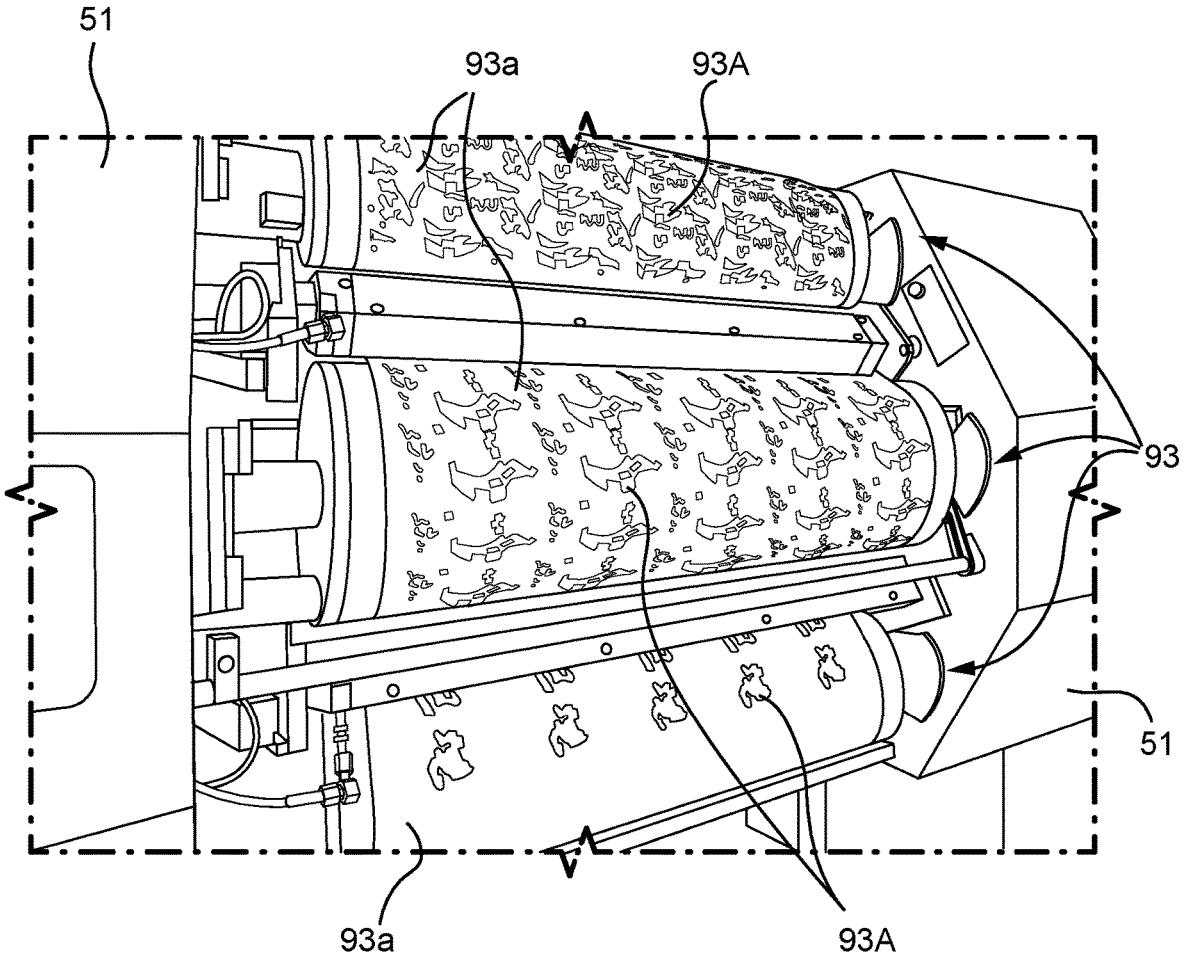
Fig. 2 (PRIOR ART)
FIG. 2 is a photographic illustration of chablon cylinders as mounted in the intaglio printing press of FIGS. 1*a* and 1*b;*
Figure 3A:
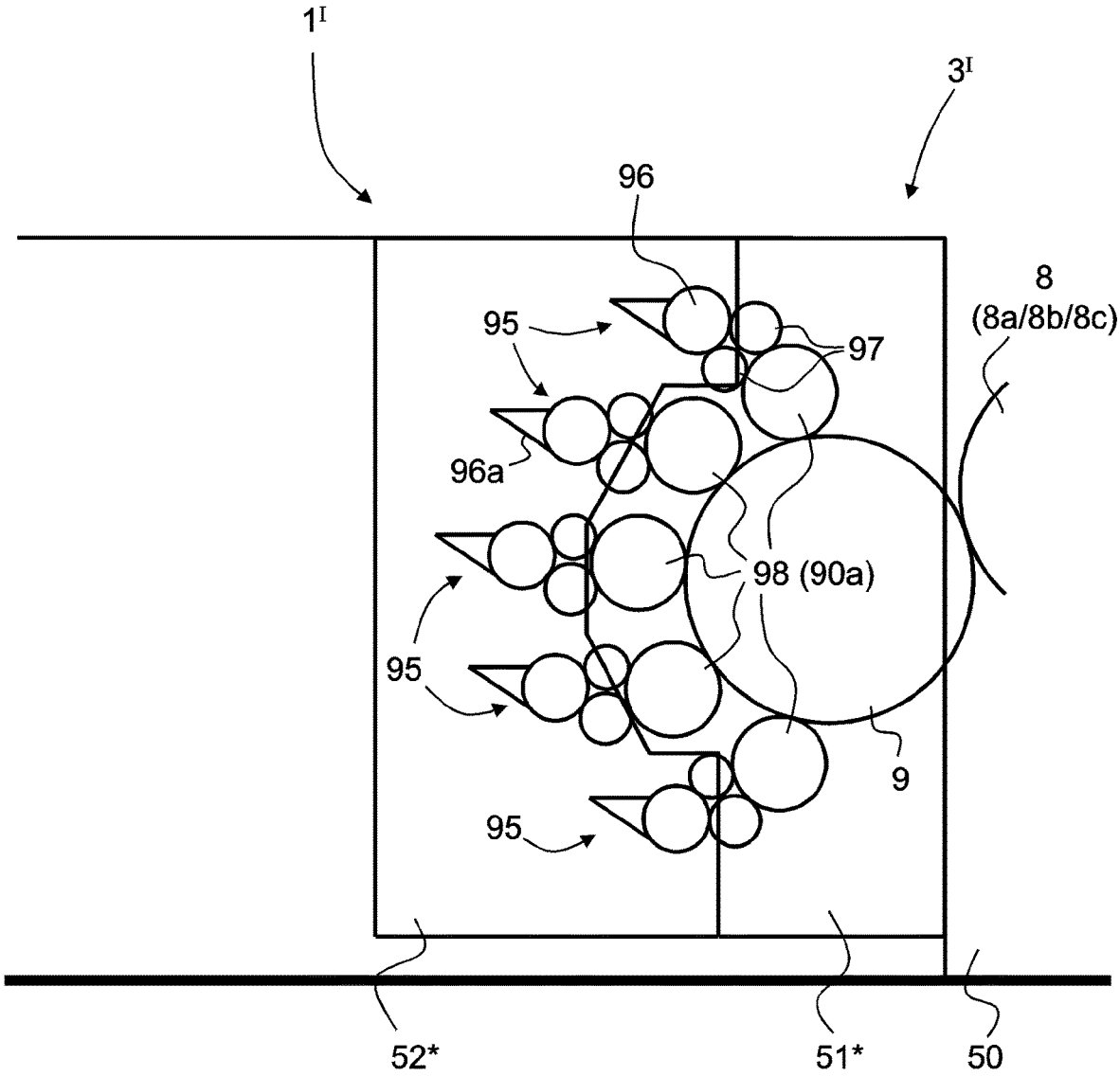
FIGS. 3*a* to 3*c* are schematic partial side views of an intaglio printing press comprising an inking system in accordance with a first embodiment of the invention.
Figure 3B:
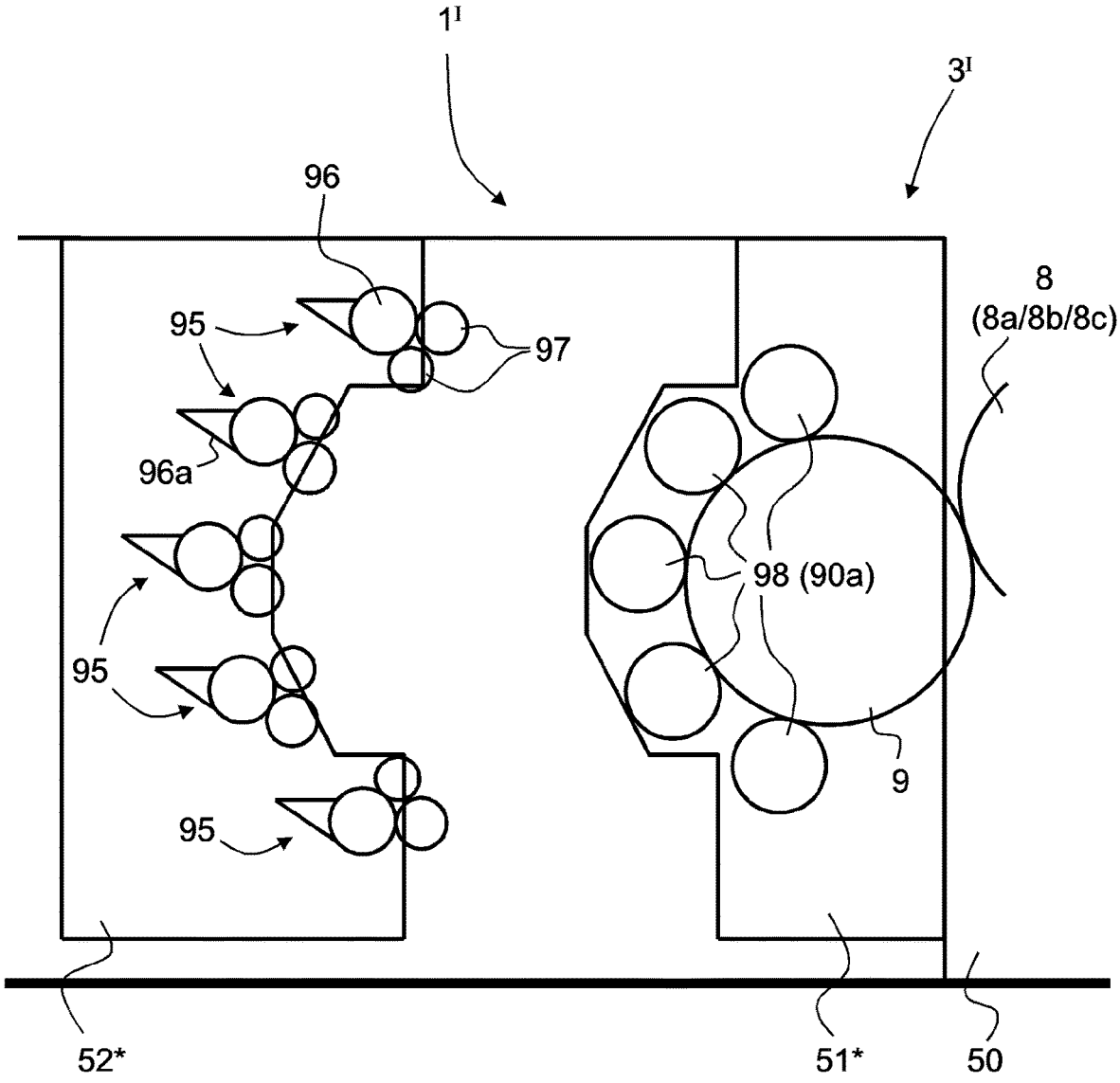
Figure 3C:
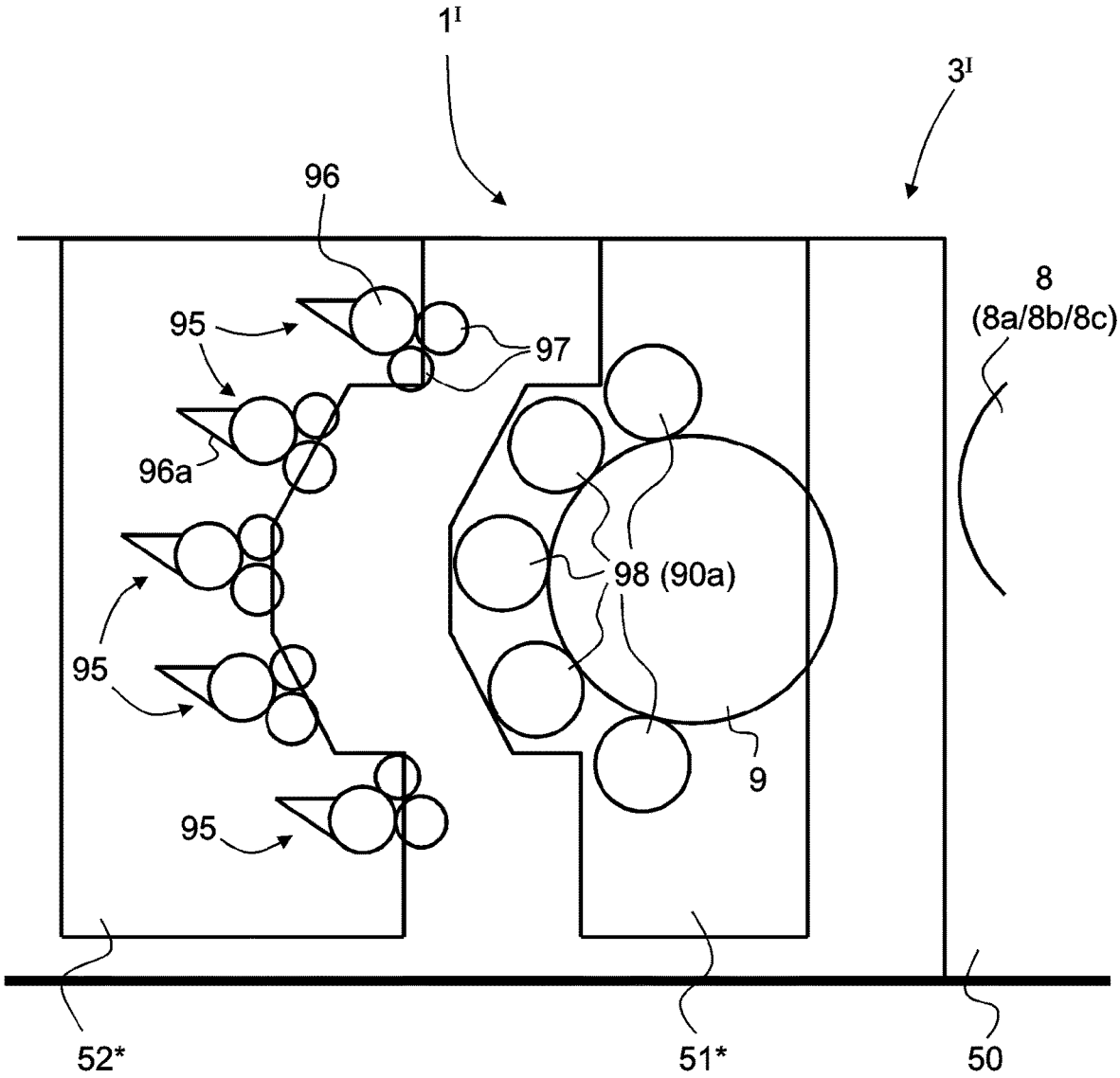

FIGS. 3*a* to 3*c* schematically illustrate an intaglio printing press comprising an inking system in accordance with a first embodiment of the invention, which intaglio printing press is generally designated by reference numeral $\mathbf{1}^{I}$. Only the relevant components of the inking system are illustrated in FIGS. 3*a* to 3*c*, including an ink collecting cylinder 9 designed to cooperate with the plate cylinder 8 of the printing unit $\mathbf{3}^{I}$ of the press and to collect inks from multiple inking devices 95 that are distributed about a portion of the circumference of the ink collecting cylinder 9. The configuration of the printing unit $\mathbf{3}^{I}$ shown in FIGS. 3*a* to 3*c* is basically similar to that of the printing unit 3 shown in FIGS. 1 and 2 except for the inking system which is different.

More precisely, in the illustrative example shown in FIGS. 3*a* to 3*c*, the inking system consists of elements designated by reference numerals 9 and 95 to 98, and includes the ink collecting cylinder 9 collecting ink patterns from a plurality of (namely five) inking devices 95 that are distributed about a portion of the circumference of the ink collecting cylinder 9. Furthermore, at least one of the inking devices 95 (preferably each inking device 95 as illustrated in FIGS. 3*a* to 3*c*) comprises a selective inking cylinder 98 that cooperates with the ink collecting cylinder 9. In the illustrated example, the selective inking cylinder 98 is a one-segment cylinder whose diameter is one third of that of the associated plate cylinder 8 and ink collecting cylinder 9. This selective inking cylinder 98 carries a selective inking plate, designated by reference 90*a*, which selective inking plate 90*a* receives ink supplied by an associated inking unit 96/96*a*/97. This inking unit is basically similar to the inking unit 91/92 shown in FIG. 1*b* and is designed as a short inking unit comprising an ink duct 96, 96*a* with a duct roller 96 supplying ink to the associated selective inking cylinder 98 via a pair of ink application rollers 97. The ink duct is here designed as an ink fountain with an ink fountain blade 96*a* cooperating with the duct roller 96 so as to form an ink reservoir between the ink fountain blade 96*a* and a portion of the circumference of the duct roller 96.

In accordance with the invention, the selective inking plate 90*a* carried by each selective inking cylinder 98 comprises a coating that is selectively structured to exhibit ink-repellent portions and perform selective transfer of ink at locations corresponding to engraved areas of the one or more intaglio printing plates 8*a*, 8*b*, 8*c* (or like intaglio printing mediums) that are to be inked with the ink supplied by the associated inking unit 96/96*a*/97. This can be achieved in different ways. A preferred solution consists in using an ink-repellent coating that is formed on top of an ink-accepting layer or base, which ink-repellent coating is selectively removed to expose the underlying ink-accepting layer or base at the locations where ink is to be selectively transferred.

Figure 8:
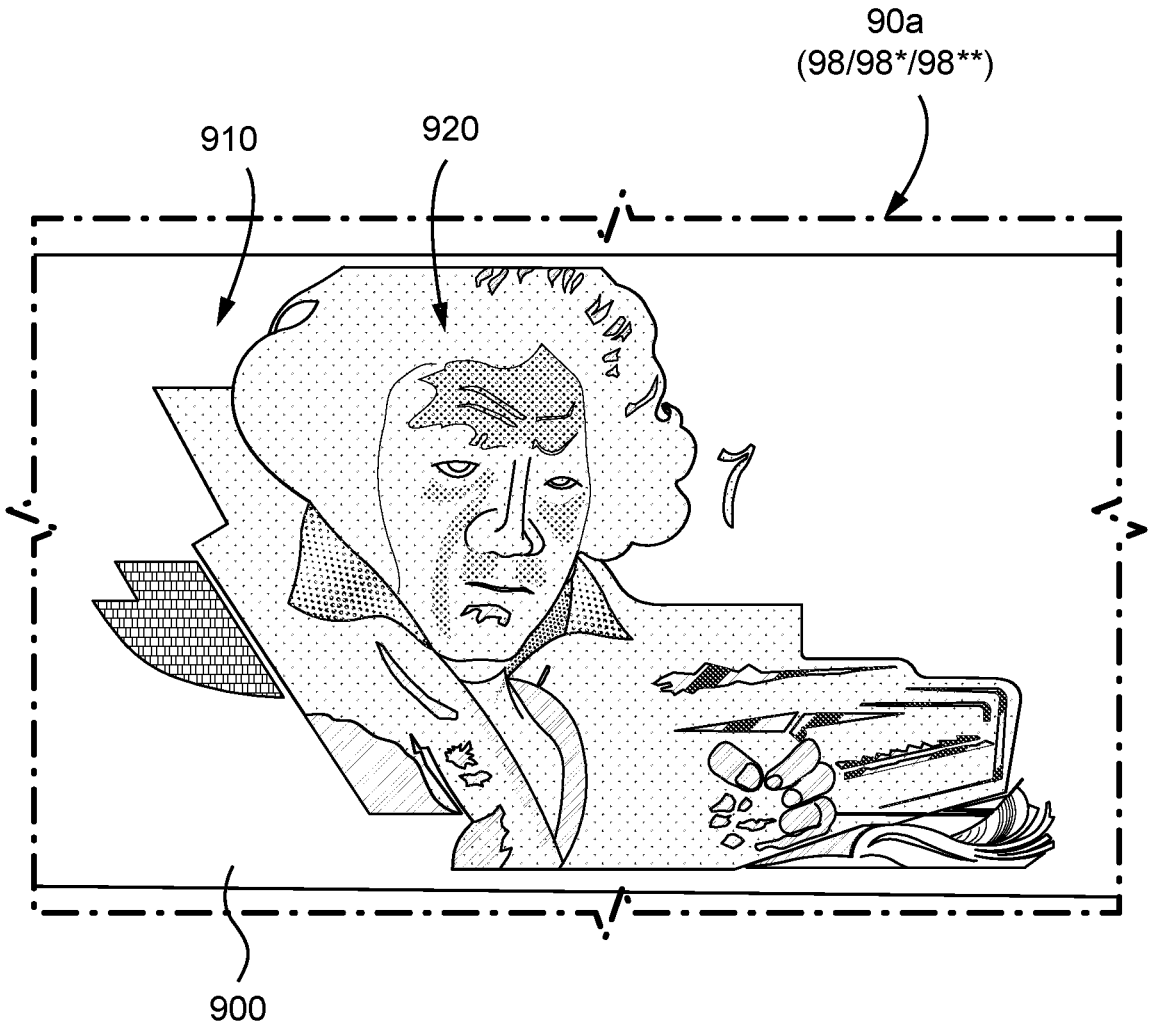
FIG. 8 is a photographic illustration of a part of a selective inking plate as used in the context of the invention.

In accordance with a particularly preferred embodiment, the selective inking plate 90*a* may consist of an ink-accepting metallic base plate (for instance an aluminium base plate) coated with an ink-repellent coating, which ink-repellent coating is selectively removed (advantageously by laser ablation using suitable laser processing equipment) to expose the underlying metallic base plate. FIG. 8 is an illustrative example of such a selective inking plate 90*a* that is provided with an ink-repellent coating 900 that is structured (i.e. ablated) to exhibit ink-repellent portions 910 and ink-accepting portions 920. In the illustrated example, the ink-repellent portions 910 are portions of the ink-repellent coating 900 that have not been removed from the plate 90*a*, while the ink-accepting portions 920 are portions of the underlying base material (e.g. the aluminium base plate) that have been exposed as a result of selective ablation of the ink-repellent coating 900.

In the present illustrative instance, an aluminium base plate was initially provided with the ink-repellent coating 900 and then processed by means of a laser-engraving apparatus to selectively remove the coating 900 at locations 920 which correspond to engraved areas of the intaglio printing plate(s) that are to be inked with the ink supplied by the associated inking unit. A suitable laser-engraving apparatus could be the Applicant's CTiP® equipment as used for the production of intaglio printing plates.

By way of alternative, the coating on the selective inking plate 90*a* could be an ink-accepting coating formed on top of an ink-repellent layer or base, which ink-accepting coating is selectively removed, especially laser-ablated, to expose the underlying ink-repellent layer or base and form the ink-repellent portions outside of the locations where ink is to be selectively transferred. In such a case, it will be appreciated that the portions of the coating that will remain on the plate after selective removal of the coating will act as ink transfer portions of the selective inking plate 90*a*.

Laser-ablation of the coating provided on the selective inking plate is preferred in that it allows great flexibility in the design of the ink-transfer regions of the selective inking plate and optimal adjustment of the resolution thereof. A chemical or mechanical ablation of the coating, or any other suitable ablation method, could however be contemplated in the context of the present invention in order to structure the coating.

The processed plate (as for instance shown in FIG. 8) exhibits substantially no relief, it being to be understood that the coating provided on the selective inking plate preferably exhibits a thickness of the order of a few microns only, which can easily be removed by laser ablation.

As further illustrated in FIGS. 3*a* to 3*c*, the inking units 96/96*a*/97 are advantageously located and supported in an inking carriage 52* that is retractable away from the ink collecting cylinder 9 during maintenance operations (see e.g. FIGS. 3*b* and 3*c*). The ink collecting cylinder 9 is likewise located and supported, together with each selective inking cylinder 98, in an intermediate carriage 51* that is retractable away from the plate cylinder 8 during maintenance operations (see e.g. FIG. 3*c*). The plate cylinder 8 is located and supported, together with the associated impression cylinder 7 and ink wiping system 10 (not shown in FIGS. 3*a* to 3*c*) in a stationary machine frame 50. It will be appreciated that this particular configuration ensures optimal accessibility to the selective inking cylinders 98, the ink collecting cylinder 9 and the plate cylinder 8 during maintenance operations, for instance for the purpose of cleaning or exchanging plates and/or blankets.

Figure 4A:
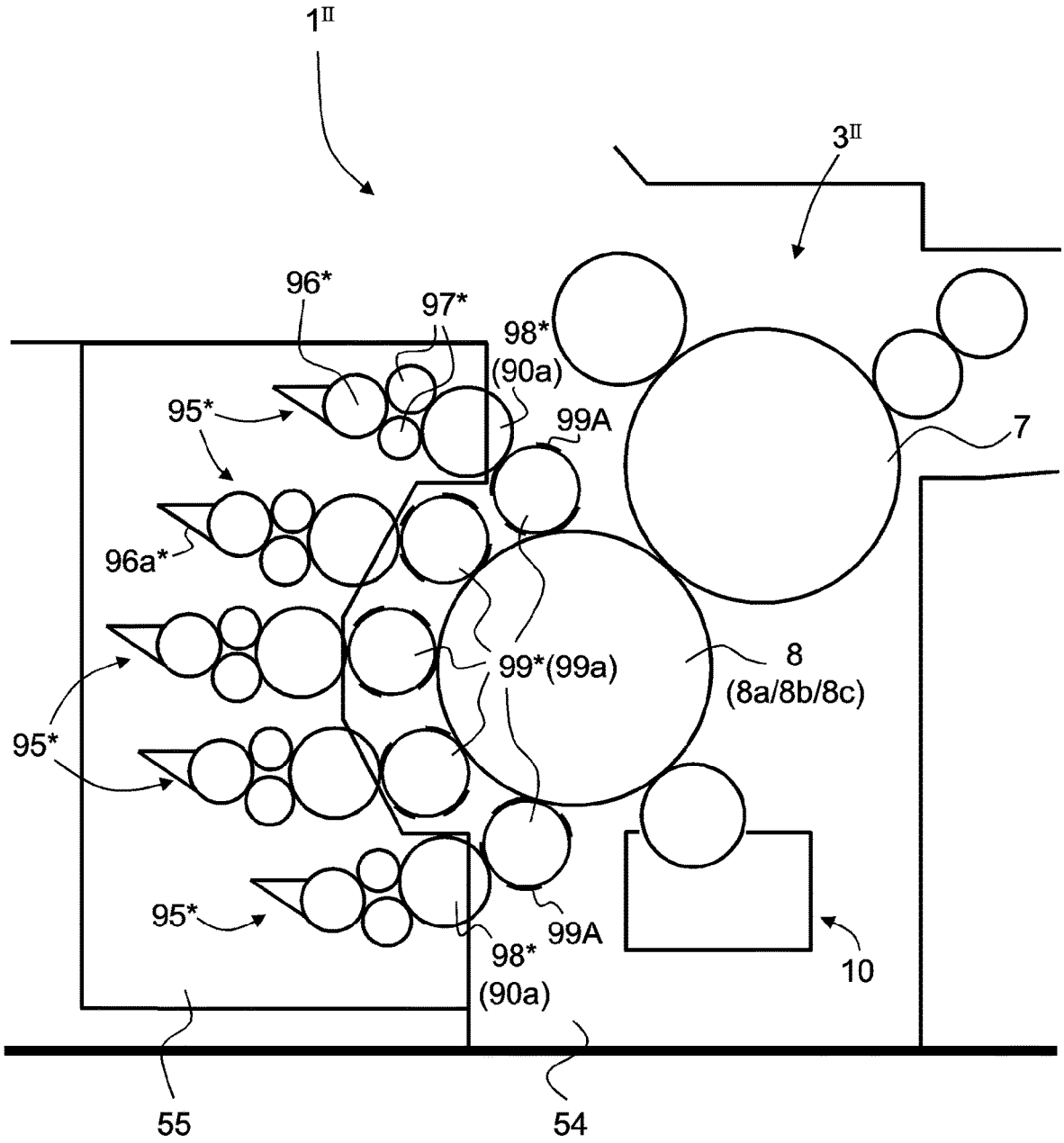
FIGS. 4*a* and 4*b* are schematic partial side views of an intaglio printing press comprising an inking system in accordance with a second embodiment of the invention.
Figure 4B:
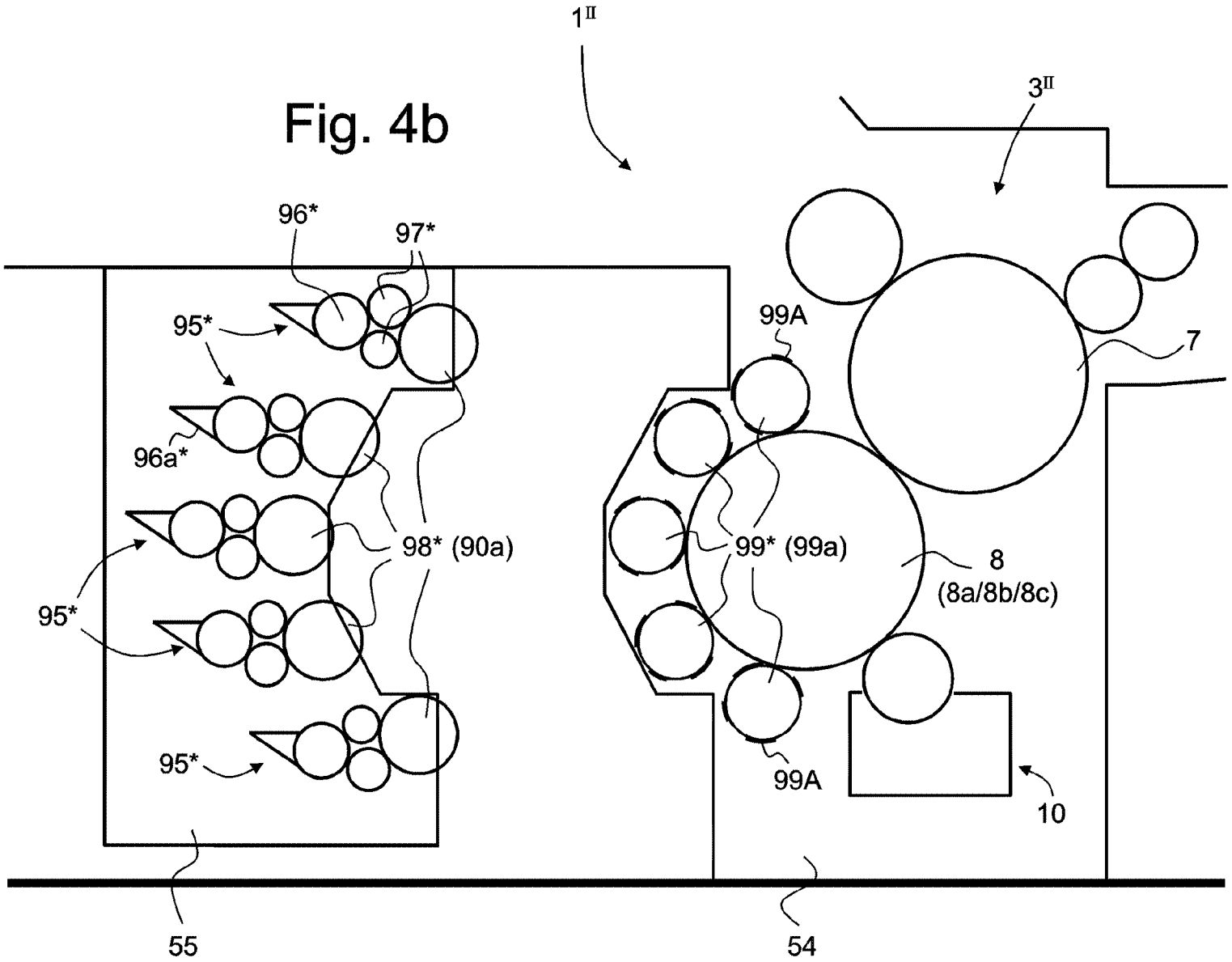

FIGS. 4*a* and 4*b* schematically illustrate an intaglio printing press comprising an inking system in accordance with a second embodiment of the invention, which intaglio printing press is generally designated by reference numeral $\mathbf{1}^{II}$. Only the relevant components of the inking system are illustrated in FIGS. 4*a* and 4*b*, including multiple inking devices 95* that are distributed about a portion of the circumference of the plate cylinder 8 of the printing unit $\mathbf{3}^{II}$ of the press. The configuration of the printing unit $\mathbf{3}^{II}$ shown in FIGS. 4*a* and 4*b* is different from that shown in FIGS. 3*a* to 3*c* in that no ink collecting cylinder is provided and in the configuration of the inking system used to ink the plate cylinder 8.

More precisely, in the illustrative example shown in FIGS. 4*a* and 4*b*, the inking system consists of elements designated by reference numerals 95* to 99*, and includes a plurality of (namely five) inking devices 95* that are distributed about a portion of the circumference of the plate cylinder 8. Each inking device 95* comprises a chablon cylinder 99* cooperating with the plate cylinder 8 and carrying a chablon plate 99*a*, which chablon plate 99*a* receives ink supplied by an associated inking unit 96*/96*a/97*. Each chablon plate 99***a* is a relief plate comprising relief portions 99A corresponding to engraved areas of the one or more intaglio printing plates 8*a* -8*c* carried by the plate cylinder 8, which engraved areas are to be inked with the ink supplied by the associated inking unit 96*/96*a/97*. Furthermore, at least one of the inking devices 95* (preferably each inking device 95* as illustrated in FIGS. 4***a* and 4*b*) further comprises a selective inking cylinder 98* that is interposed between the chablon cylinder 99* and the associated inking unit 96*/96*a/97*. As in the first embodiment, this selective inking cylinder 98* carries a selective inking plate 90***a*, which selective inking plate 90*a* receives ink supplied by the associated inking unit 96*/96*a/97*. This inking unit is basically similar to the inking unit 96/96***a*/97 shown in FIGS. 3*a* to 3*c* and is designed as a short inking unit comprising an ink duct 96*, 96*a with a duct roller 96* supplying ink to the associated selective inking cylinder 98* via a pair of ink application rollers 97*. The ink duct is likewise designed as an ink fountain with an ink fountain blade 96*a cooperating with the duct roller 96* so as to form an ink reservoir between the ink fountain blade 96*a and a portion of the circumference of the duct roller 96***.

In the illustrated example, it will be appreciated that the selective cylinders 98* and chablon cylinders 99* are each one-segment cylinders whose diameter is one third of that of the plate cylinder 8.

The same selective inking plate 90*a* as discussed above can be used in the context of this second embodiment and the aforementioned considerations with respect to the design and production of the selective inking plate 90*a* equally apply in this other embodiment.

As further illustrated in FIGS. 4*a* and 4*b*, the inking units 96*/96*a**/97* are advantageously located and supported, together with each selective inking cylinder 98*, in an inking carriage 55 that is retractable away from the plate cylinder 8 during maintenance operations (see e.g. FIG. 4***b*). In this other example, the plate cylinder 8 is located and supported, together with the chablon cylinders 99*, the associated impression cylinder 7 and ink wiping system 10 in a stationary machine frame 54. It will once again be appreciated that this particular configuration ensures optimal accessibility to the selective inking cylinders 98*, the chablon cylinders 99* and the plate cylinder 8 during maintenance operations, for instance for the purpose of cleaning or exchanging plates.

Figure 5A:
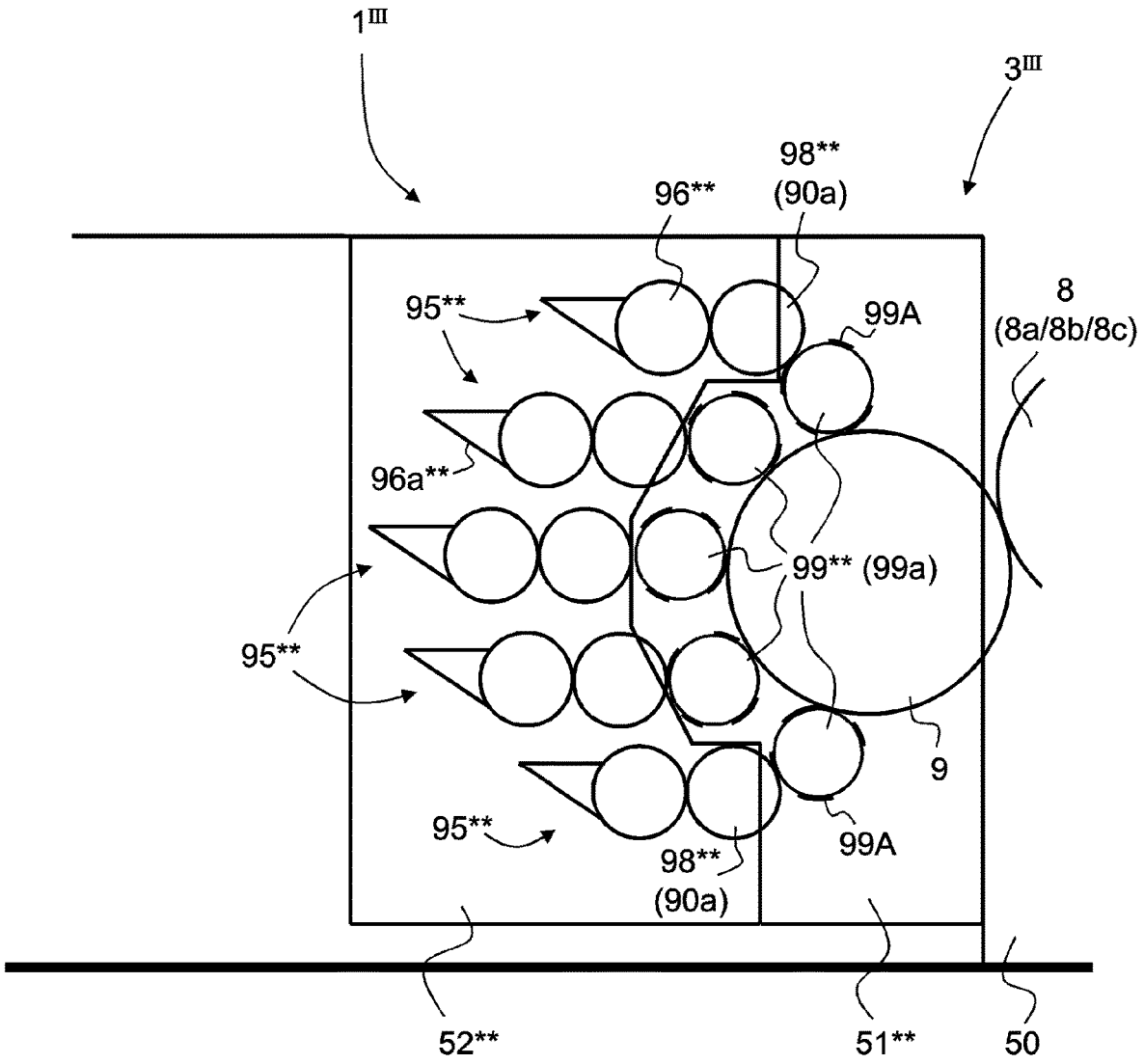
FIGS. 5*a* and 5*b* are schematic partial side views of an intaglio printing press comprising an inking system in accordance with a third embodiment of the invention.
Figure 5B:
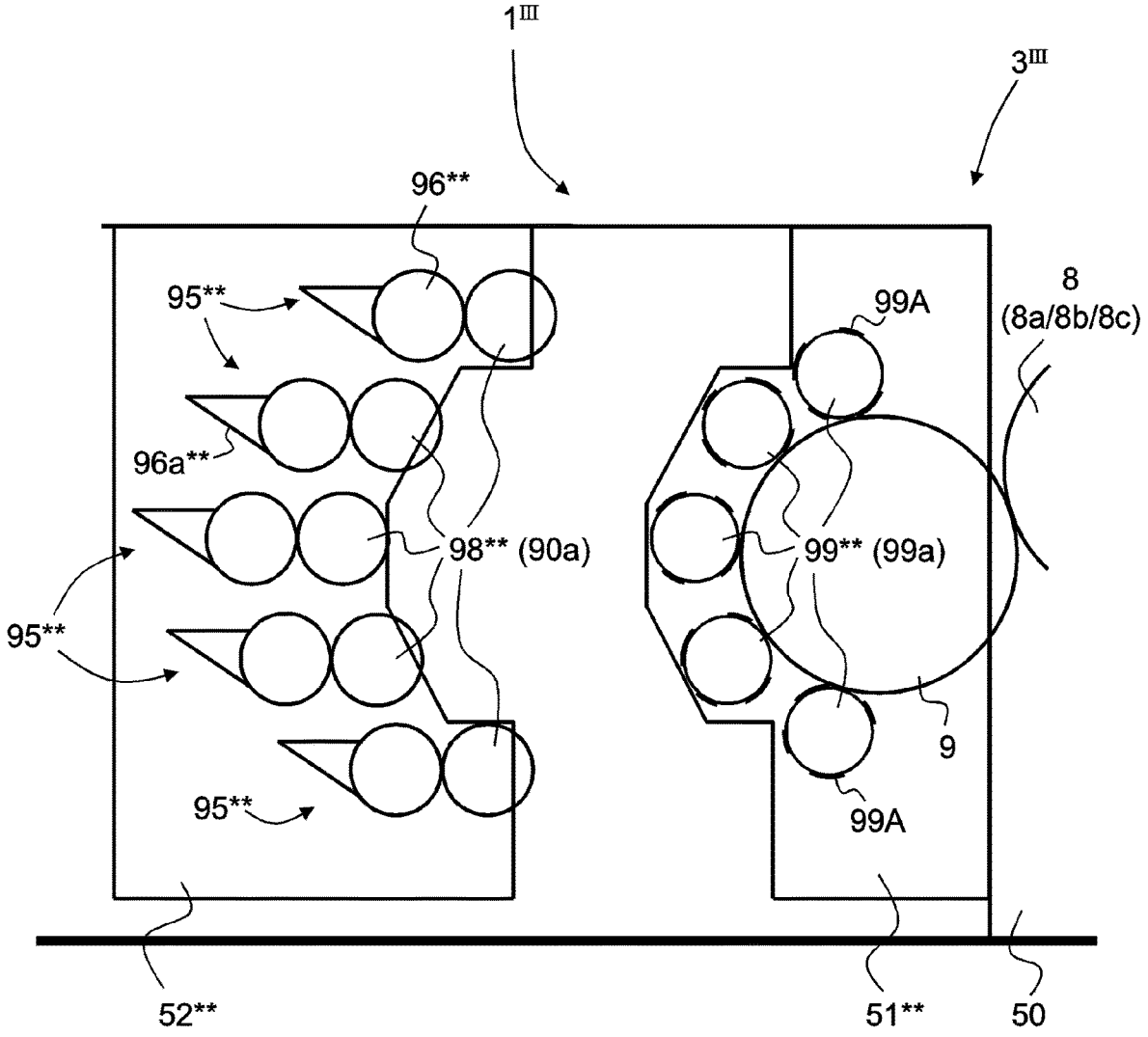

FIGS. 5*a* and 5*b* schematically illustrate an intaglio printing press comprising an inking system in accordance with a third embodiment of the invention, which intaglio printing press is generally designated by reference numeral $\mathbf{1}^{III}$. Only the relevant components of the inking system are illustrated in FIGS. 5*a* and 5*b*, including an ink collecting cylinder 9 designed to cooperate with the plate cylinder 8 of the printing unit $\mathbf{3}^{III}$ of the press and to collect inks from multiple inking devices 95 that are distributed about a portion of the circumference of the ink collecting cylinder 9. The configuration of the printing unit $\mathbf{3}^{III}$ shown in FIGS. 5***a* and 5*b* differs from that of the first and second embodiments.

More precisely, in the illustrative example shown in FIGS. 5*a* and 5*b*, the inking system consists of elements designated by reference numerals 95, 96**, 98** and 99**, and includes a plurality of (namely five) inking devices 95** that are distributed about a portion of the circumference of the ink collecting cylinder 9. Each inking device 95** comprises a chablon cylinder 99** cooperating with the ink collecting cylinder 9 and carrying a chablon plate 99***a*, which chablon plate 99*a* receives ink supplied by an associated inking unit 96/96*a. Each chablon plate 99***a* is a relief plate comprising relief portions 99A corresponding to engraved areas of the one or more intaglio printing plates 8*a* -8*c* carried by the plate cylinder 8, which engraved areas are to be inked with the ink supplied by the associated inking unit 96/96*a. Furthermore, at least one of the inking devices 95** (preferably each inking device 95** as illustrated in FIGS. 5***a* and 5*b*) further comprises a selective inking cylinder 98 that is interposed between the chablon cylinder 99** and the associated inking unit 96**/96*a. As in the first and second embodiments, this selective inking cylinder 98** carries a selective inking plate 90***a*, which selective inking plate 90*a* receives ink supplied by the associated inking unit 96/96*a. While likewise designed as a short inking unit, this inking unit differs from the inking unit 96/96***a*/97, resp. 96*/96*a**/97* shown in FIGS. 3***a*-3*c* and 4*a*-4*b* in that it comprises an ink duct 96, 96*a with a duct roller 96** supplying ink directly to the associated selective inking cylinder 98**. The ink duct is likewise designed as an ink fountain with an ink fountain blade 96*a cooperating with the duct roller 96** so as to form an ink reservoir between the ink fountain blade 96*a and a portion of the circumference of the duct roller 96****.

The same selective inking plate 90a as discussed above can once again be used in the context of this third embodiment and the aforementioned considerations with respect to the design and production of the selective inking plate 90*a* are likewise applicable.

In accordance with a particularly advantageous variant of this third embodiment, the duct roller 96 could be provided with engravings corresponding to engraved areas of the one or more intaglio printing plates 8***a*, 8*b*, 8*c* that are to be inked with the ink supplied by the inking unit 96/96*a, in a manner similar to what is being contemplated in International Publication No. WO 2005/077656 A1 or European Patent Publication No. EP 0 176 702 A1. With such a configuration, the engraved duct roller 96** would provide the ability to modulate the volume of ink independently for each engraved areas of the intaglio printing plates 8***a*, 8*b*, 8*c*, while the selective inking cylinder 98 would provide the ability to precisely delineate the relevant engraved areas of the intaglio printing plates 8***a*, 8*b*, 8*c* to which ink is to be selectively transferred.

In the present instance, the (engraved) duct roller 96 preferably exhibits the same diameter as that of the associated selective inking cylinder 98** and chablon cylinder 99**, i.e. an integer fraction 1/n of the diameter of the plate cylinder 8. In the illustrated example, cylinders 96**, 98**, 99** are all one-segment cylinders exhibiting a diameter that is one third of the diameter of the associated plate cylinder 8 and ink collecting cylinder 9**.

As further illustrated in FIGS. 5*a* and 5*b*, the inking units 96/96*a are advantageously located and supported, together with each selective inking cylinder 98**, in an inking carriage 52** that is retractable away from the ink collecting cylinder 9 during maintenance operations (see e.g. FIG. 5***b*). In this other example, the ink collecting cylinder 9 is located and supported, together with the chablon cylinders 99, in an intermediate carriage 51** that is retractable away from the plate cylinder 8 during maintenance operations. The plate cylinder 8 is located and supported, together with the associated impression cylinder 7 and ink wiping system 10 (not shown in FIGS. 5***a* and 5*b*) in a stationary machine frame 50. As with the other embodiments, it will be appreciated that this particular configuration ensures optimal accessibility to the selective inking cylinders 98, the chablon cylinders 99**, the ink collecting cylinder 9 and the plate cylinder 8** during maintenance operations, for instance for the purpose of cleaning or exchanging plates and/or blankets.

Figure 6:
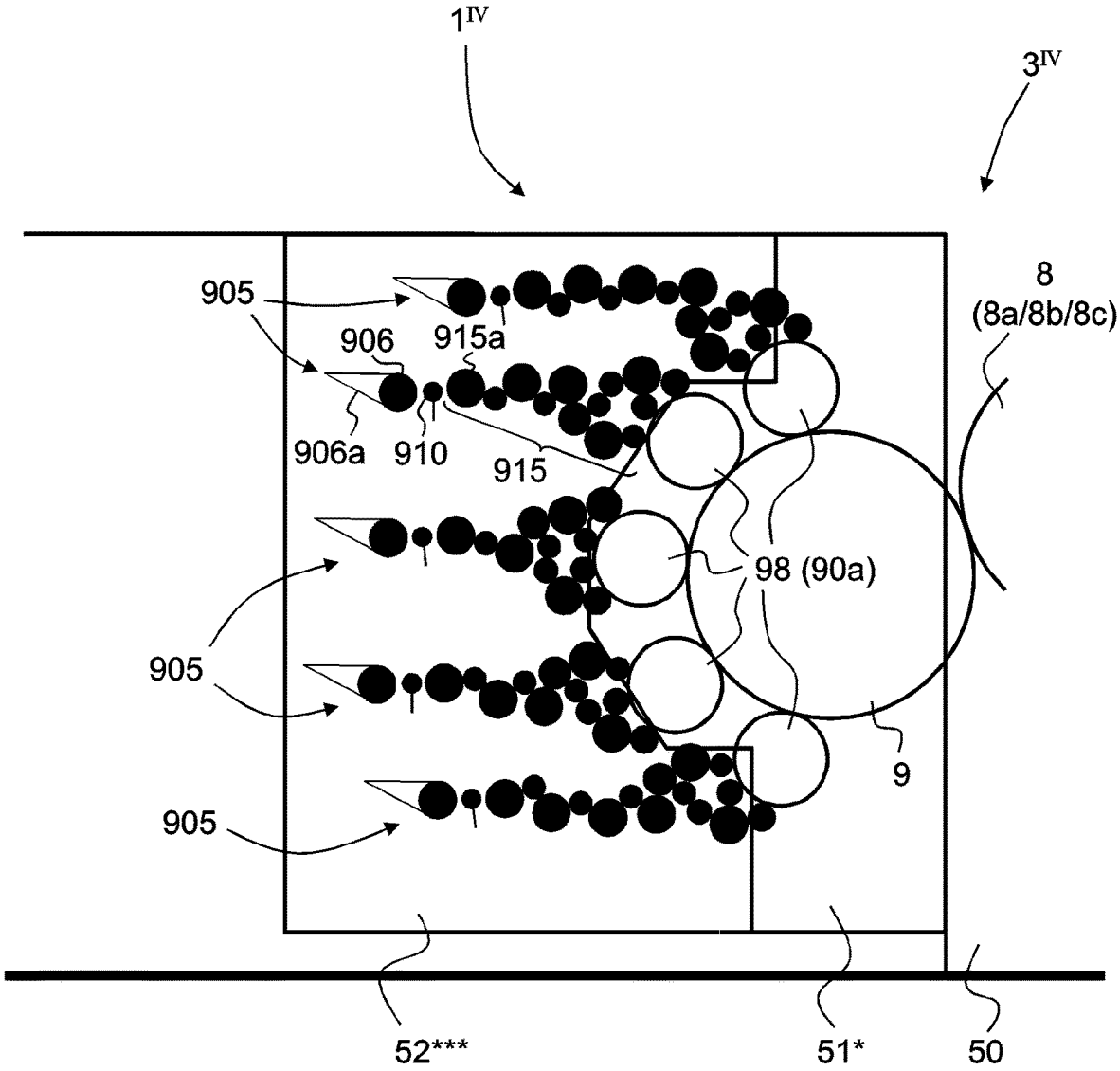
FIG. 6 is a schematic partial side view of an intaglio printing press comprising an inking system in accordance with a fourth embodiment of the invention.

FIG. 6 schematically illustrates an intaglio printing press comprising an inking system in accordance with a fourth embodiment of the invention, which intaglio printing press is generally designated by reference numeral $\mathbf{1}^{IV}$. Only the relevant components of the inking system are illustrated in FIG. 6, including an ink collecting cylinder 9 designed to cooperate with the plate cylinder 8 of the printing unit $\mathbf{3}^{IV}$ of the press and to collect inks from multiple inking devices 905 that are distributed about a portion of the circumference of the ink collecting cylinder 9. The configuration of the printing unit $\mathbf{3}^{IV}$ shown in FIG. 6 is basically similar to that of the first embodiment shown in FIGS. 3*a* to 3*c*, with the exception of the inking units used to supply ink to the selective inking cylinders 98.

More precisely, in the illustrative example shown in FIG. 6, the inking system consists of elements designated by reference numerals 9, 98, 905, 906, 906*a*, 910 and 915, and includes the ink collecting cylinder 9 collecting ink patterns from a plurality of (namely five) inking devices 905 that are distributed about a portion of the circumference of the ink collecting cylinder 9. Like in the first embodiment, at least one of the inking devices 905 (preferably each inking device 905 as illustrated in FIG. 6) comprises a selective inking cylinder 98 that cooperates with the ink collecting cylinder 9 and carries a selective inking plate 90*a* which receives ink supplied by an associated inking unit 906/906*a*/910/915. This inking unit differs from the inking unit used in the embodiment of FIGS. 3*a*-3*c* in that it is designed as a long inking unit comprising an ink duct 906, 906*a* with a duct roller 906 (that is advantageously designed as an ink fountain with an ink fountain blade 906*a* cooperating with the duct roller 906) inking the selective inking plate 90*a* via a plurality of ink transfer rollers 915. Preferably, each inking unit 906/906*a*/910/915 further comprises a vibrator roller 910 interposed between the duct roller 906 and a first one 915*a* of the ink transfer rollers 915. Such vibrator-type inking units 906/906*a*/910/915 are known as such in the art, but are normally used as inking units in offset or letterpress printing presses.

This particular inking unit 906/906*a*/910/915 is advantageous in that it opens the possibility to use a profiled vibrator roller 910 in accordance with the teaching of International Publication No. WO 2016/042482 A2 in the name of the instant Applicant, which publication is incorporated herein by reference in its entirety.

In a manner similar to the first embodiment, the inking units 906/906*a*/910/915 are advantageously located and supported in an inking carriage 52*  that is retractable away from the ink collecting cylinder 9 during maintenance operations. The ink collecting cylinder 9 is likewise located and supported, together with each selective inking cylinder 98, in an intermediate carriage 51* that is retractable away from the plate cylinder 8 during maintenance operations. The plate cylinder 8 is similarly located and supported, together with the associated impression cylinder 7 and ink wiping system 10 (not shown in FIG. 6) in a stationary machine frame 50. This ensures optimal accessibility to the selective inking cylinders 98, the ink collecting cylinder 9 and the plate cylinder 8** during maintenance operations, for instance for the purpose of cleaning or exchanging plates and/or blankets.

Figure 7:
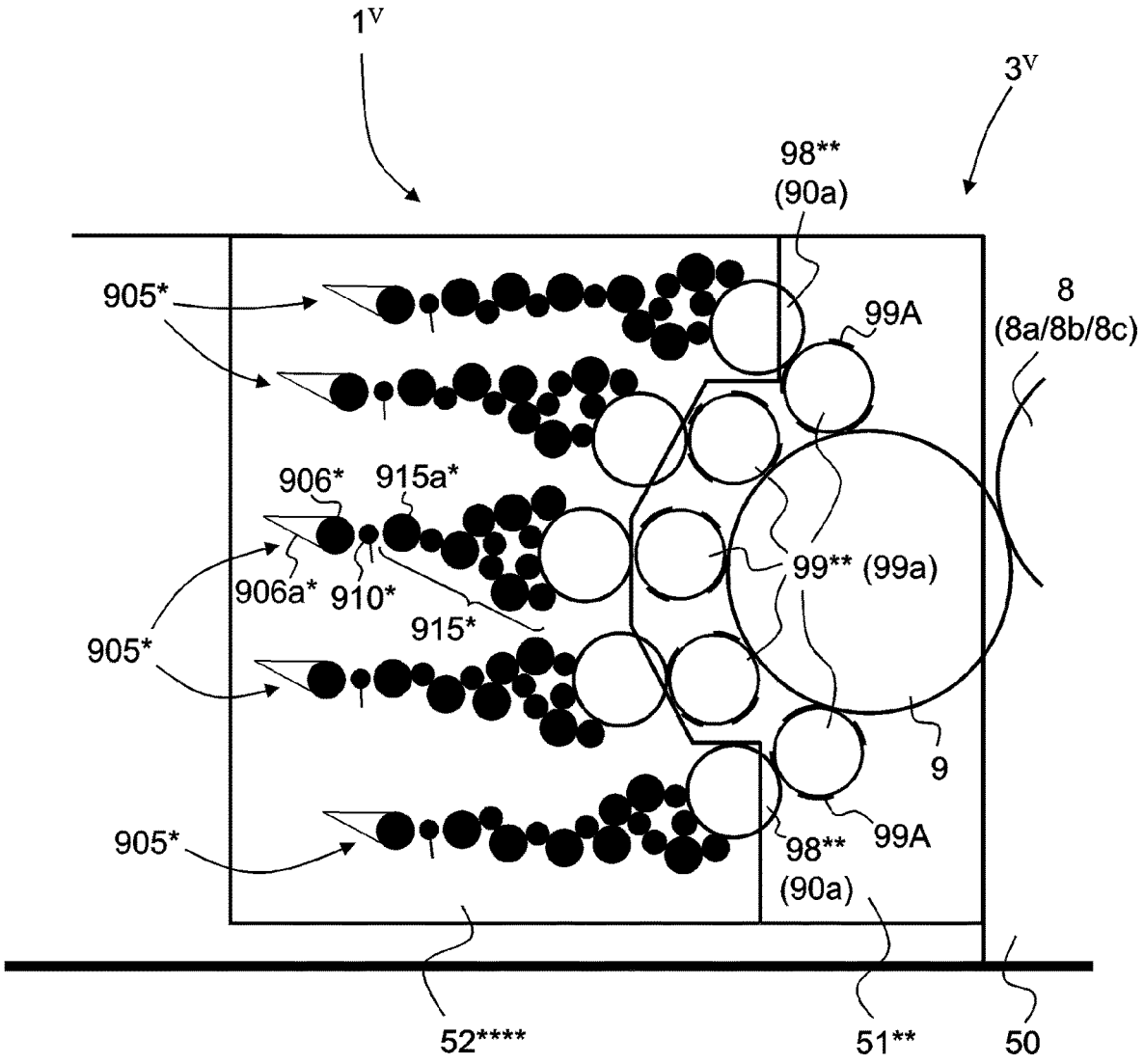
FIG. 7 is a schematic partial side view of an intaglio printing press comprising an inking system in accordance with a fifth embodiment of the invention.

FIG. 7 schematically illustrates an intaglio printing press comprising an inking system in accordance with a fifth embodiment of the invention, which intaglio printing press is generally designated by reference numeral $\mathbf{1}^{V}$. Only the relevant components of the inking system are illustrated in FIG. 7, including an ink collecting cylinder 9 designed to cooperate with the plate cylinder 8 of the printing unit $\mathbf{3}^{V}$ of the press and to collect inks from multiple inking devices 905* that are distributed about a portion of the circumference of the ink collecting cylinder 9. The configuration of the printing unit $\mathbf{3}^{V}$ shown in FIG. 7 is basically similar to that of the third embodiment shown in FIGS. 5*a* and 5*b*, with the exception of the inking units used to supply ink to the selective inking cylinders 98, which inking units are similar to those used in the context of the fourth embodiment of FIG. 6**.

More precisely, in the illustrative example shown in FIG. 7, the inking system consists of elements designated by reference numerals 9, 98, 905*, 906*, 906*a, 910* and 915*, and includes the ink collecting cylinder 9 collecting ink patterns from a plurality of (namely five) inking devices 905* that are distributed about a portion of the circumference of the ink collecting cylinder 9. Like in the third embodiment, each inking device 905* comprises a chablon cylinder 99** cooperating with the ink collecting cylinder 9 and carrying a chablon plate 99***a*, which chablon plate 99*a* receives ink supplied by an associated inking unit **906*/906*a**/910*/915* which is similar to the inking unit 906/906*a*/910/915 used in the context of the fourth embodiment of FIG. 6. Furthermore, at least one of the inking devices 905* (preferably each inking device 905* as illustrated in FIG. 7) further comprises a selective inking cylinder 98** that is interposed between the chablon cylinder 99** and the associated inking unit 906*/906*a**/910*/915*. This inking unit differs from the inking unit used in the embodiment of FIGS. 5***a* and 5*b* in that it is designed as a long inking unit comprising an ink duct 906*, 906*a** with a duct roller 906* (that is advantageously designed as an ink fountain with an ink fountain blade 906*a cooperating with the duct roller 906*) inking the selective inking plate 90***a* via a plurality of ink transfer rollers 915*. Preferably, each inking unit **906*/906*a**/910*/915* further comprises a vibrator roller 910* interposed between the duct roller 906* and a first one 915*a of the ink transfer rollers 915*, thereby providing the same advantages as the fourth embodiment of FIG. 6**.

In a manner similar to the third embodiment, the inking units **906*/906*a**/910*/915* are advantageously located and supported, together with each selective inking cylinder 98**, in an inking carriage 52**** that is retractable away from the ink collecting cylinder 9 during maintenance operations. The ink collecting cylinder 9 is likewise located and supported, together with the chablon cylinders 99**, in an intermediate carriage 51** that is retractable away from the plate cylinder 8 during maintenance operations. The plate cylinder 8 is similarly located and supported, together with the associated impression cylinder 7 and ink wiping system 10 (not shown in FIG. 7) in a stationary machine frame 50. This likewise ensures optimal accessibility to the selective inking cylinders 98**, the chablon cylinders 99**, the ink collecting cylinder 9 and the plate cylinder 8** during maintenance operations, for instance for the purpose of cleaning or exchanging plates and/or blankets.

The fourth and fifth embodiments likewise rely on the use of a selective inking plate 90*a* similar to the selective inking plate used in the context of the first to third embodiments.

Various modifications and/or improvements may be made to the above-described embodiments without departing from the scope of the invention as defined by the annexed claims. For instance, while the disclosed embodiments relate to intaglio printing presses of the type comprising a plate cylinder carrying one or more intaglio printing plates, the invention is applicable to any and all intaglio printing presses comprising an intaglio printing cylinder carrying one or more intaglio printing mediums, such as an intaglio printing sleeve.

In addition, while the disclosed embodiments make use of a selective inking cylinder in each inking device, one or only some of the inking devices could be provided with such a selective inking cylinder. For instance, with respect to the first and fourth embodiments of FIGS. 3*a*-3*c* and 6, any one of the inking devices 95, resp. 905, could be designed as a conventional inking device comprising a chablon cylinder instead of the selective inking cylinder 98.

Likewise, with respect to the second, third and fifth embodiments of FIGS. 4*a*-4*b*, 5*a*-5*b* and 7, one or only some of the inking devices 95*, 95, resp. 905*, could be provided with a selective inking cylinder 98*, resp. 98**. It will be appreciated however that the second, third and fifth embodiments of FIGS. 4***a*-4*b*, 5*a*-5*b* and 7 are particularly advantageous in that any one of the selective inking plate 90*a* could be replaced by a simple ink transfer blanket so as to easily reconfigure the relevant inking device to operate in a manner similar to a conventional chablon-type inking device (in which case the relevant selective inking cylinder 98*, resp. 98, would merely act as an ink transfer cylinder transferring ink to the downstream located chablon cylinder 99*, resp. 99****).

In any event, it shall furthermore be appreciated that all of the disclosed embodiments are adapted to carry out a process of inking an intaglio printing cylinder of an intaglio printing press, which intaglio printing cylinder carries one or more intaglio printing mediums, which process per se also forms part of the instant invention. As discussed above, this process includes inking the one or more intaglio printing mediums by means of a plurality of inking devices, wherein a selective transfer of ink to the one or more intaglio printing mediums is performed by means of a selective inking cylinder provided in at least one of the inking devices, preferably in each of the inking devices, which selective inking cylinder carries a selective inking plate receiving ink supplied by an associated inking unit. According to the invention, the selective inking plate comprises a coating that is selectively structured to exhibit ink-repellent portions and perform selective transfer of ink at locations corresponding to engraved areas of the one or more intaglio printing mediums that are to be inked with the ink supplied by the associated inking unit. Furthermore, the selective transfer of ink is performed indirectly from the selective inking cylinder to the one or more intaglio printing mediums (i) via an ink collecting cylinder (as shown for instance in FIGS. 3*a*-3*c* and 6), (ii) via a chablon cylinder carrying a chablon plate comprising relief portions corresponding to engraved areas of the one or more intaglio printing mediums that are to be inked with the ink supplied by the associated inking unit (as shown in FIGS. 4*a*-4*b*) or (iii) via a combination of both (as shown for instance in FIGS. 5*a*-5*b* and 7).

LIST OF REFERENCE NUMERALS USED THEREIN

Figure 1A:
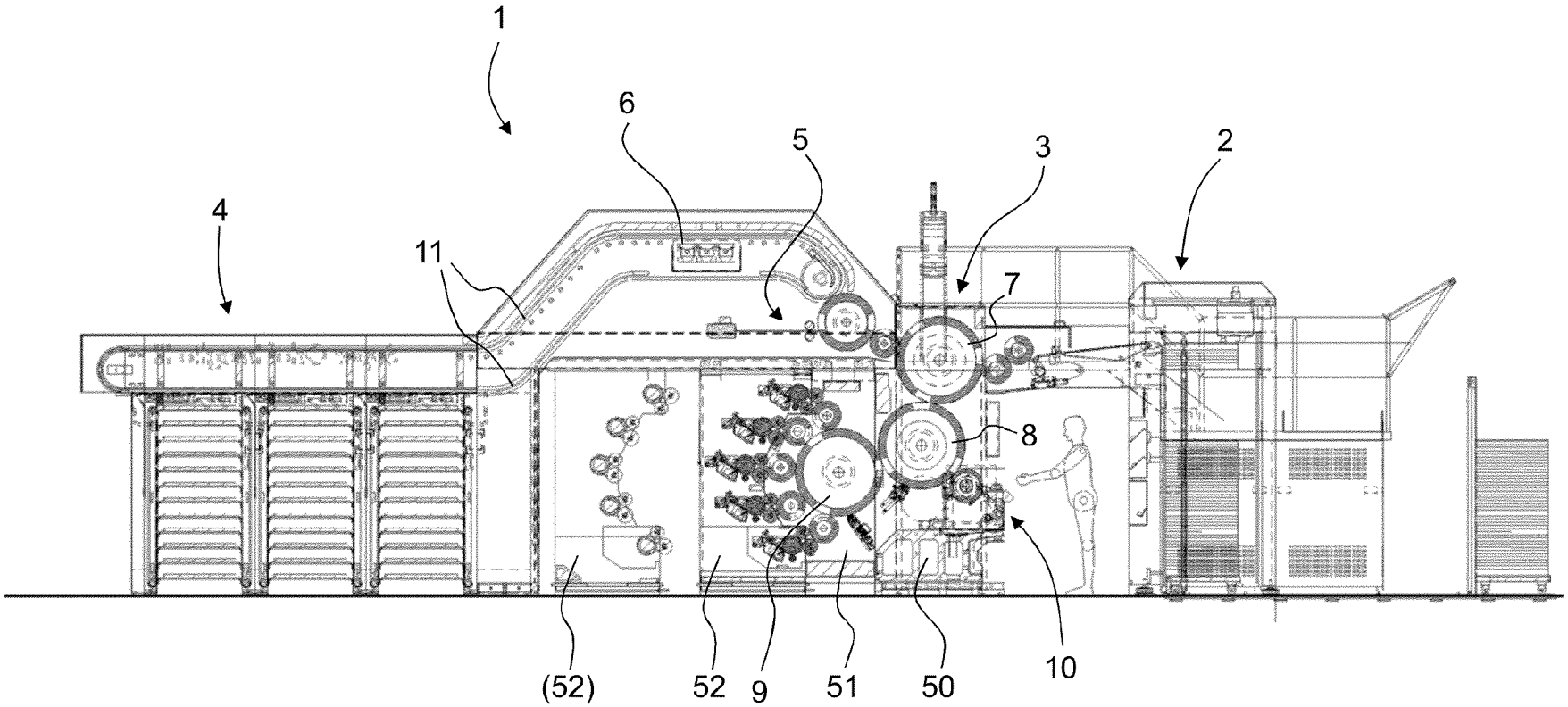
Fig. 1a (PRIOR ART)
FIG. 1*a* is a side-view of a known intaglio printing press as for instance disclosed in International Publication No. WO 2013/153519 A2.
Figure 1B:
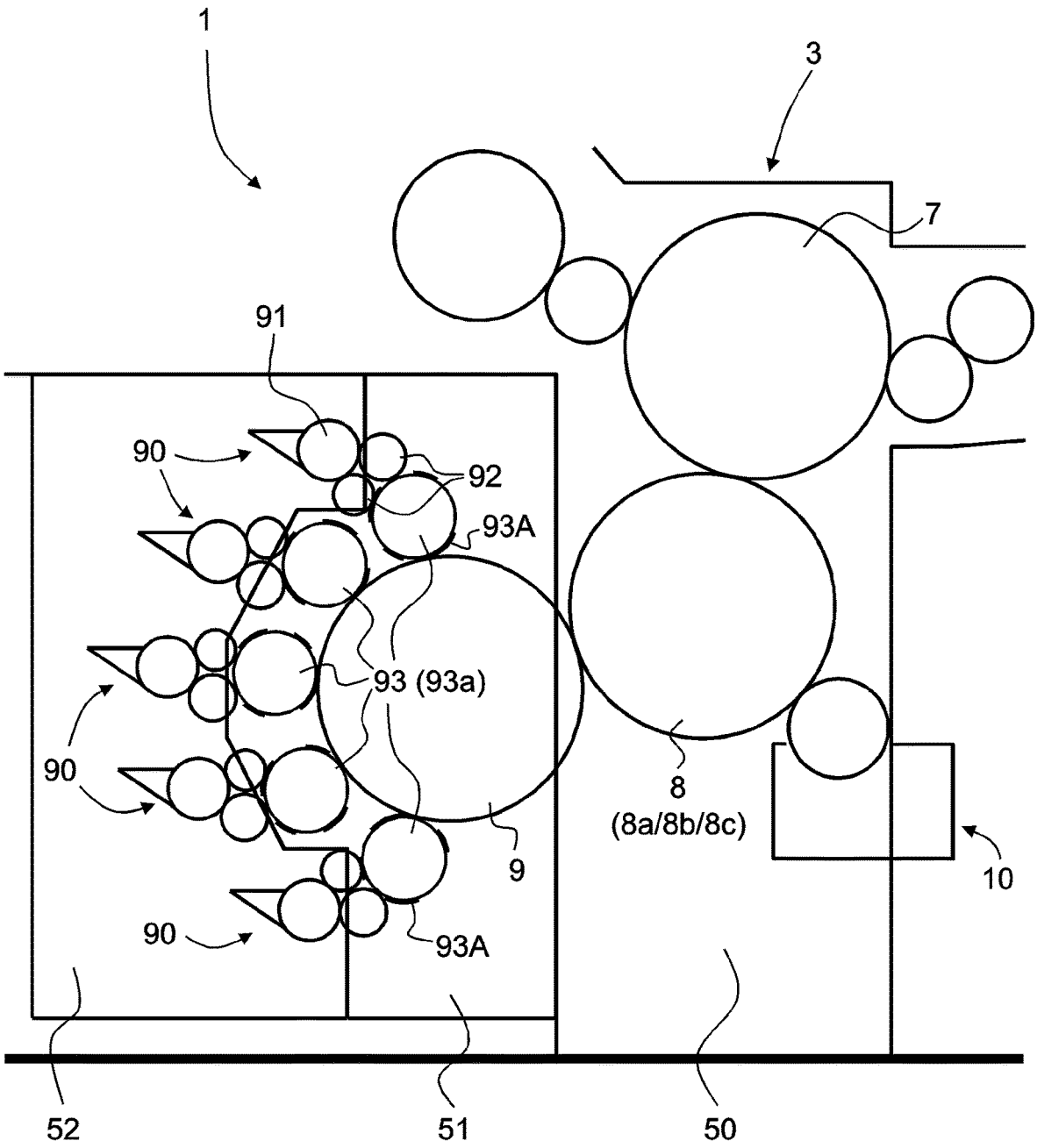
Fig. 1b (PRIOR ART)
FIG. 1*b* is an enlarged schematic side view of the printing unit of the intaglio printing press of FIG. 1*a;*

1 (sheet-fed) intaglio printing press (prior art of FIGS. 1-2)

1$^{I}$ (sheet-fed) intaglio printing press (first embodiment of FIGS. 3*a*-3*c*)

1$^{II}$ (sheet-fed) intaglio printing press (second embodiment of FIGS. 4*a*-4*b*)

1$^{III}$ (sheet-fed) intaglio printing press (third embodiment of FIGS. 5*a*-5*b*)

1$^{IV}$ (sheet-fed) intaglio printing press (fourth embodiment of FIG. 6)

1$^{V}$ (sheet-fed) intaglio printing press (fifth embodiment of FIG. 7)

2 sheet feeder

3 intaglio printing unit (prior art of FIGS. 1-2)

3$^{I}$ intaglio printing unit (first embodiment of FIGS. 3*a*-3*c*)

3$^{II}$ intaglio printing unit (second embodiment of FIGS. 4*a*-4*b*)

3$^{III}$ intaglio printing unit (third embodiment of FIGS. 5*a*-5*b*)

3$^{IV}$ intaglio printing unit (fourth embodiment of FIG. 6)

3$^{V}$ intaglio printing unit (fifth embodiment of FIG. 7)

4 sheet delivery (with three delivery pile units)

5 optical inspection system (e.g. NoteSave® system)

6 drying or curing unit

7 impression cylinder (three-segment cylinder)

8 intaglio printing cylinder (e.g. three-segment plate cylinder)

8*a*-*c* intaglio printing mediums (e.g. three intaglio printing plates carried by plate cylinder 8)

9 ink collecting cylinder/Orlof cylinder (three-segment blanket cylinder—prior art of FIGS. 1-2/first and third to fifth embodiments of FIGS. 3*a*-3*c* and 5*a*-5*b* to 7)

10 ink wiping system

11 sheet transporting system (sheet conveyor system with a pair of endless chains driving a plurality of spaced-apart gripper bars for holding a leading edge of the sheets)

50 stationary machine frame supporting impression cylinder 7 and plate cylinder 8 (prior art of FIGS. 1-2/first and third to fifth embodiments of FIGS. 3*a*-3*c* and 5*a*-5*b* to 7)

51 intermediate carriage supporting ink collecting cylinder 9 and chablon cylinders 93 (prior art of FIGS. 1-2)

51* intermediate carriage supporting ink collecting cylinder 9 and selective inking cylinders 98 (first and fourth embodiments of FIGS. 3*a*-3*c* and 6)

51 intermediate carriage supporting ink collecting cylinder 9 and chablon cylinders 99** (third and fifth embodiments of FIGS. 5***a*-5*b* and 7)

52 inking carriage supporting inking units 91/92 (prior art of FIGS. 1-2)

52* inking carriage supporting inking units 96/96a/97 (first embodiment of FIGS. 3*a*-3*c*)

52 inking carriage supporting inking units 96**/96*** and selective inking cylinders 98** (third embodiment of FIGS. 5***a*-5*b*)

52* inking carriage supporting inking units 906/906***a*/910/915 (fourth embodiment of FIG. 6)

52** inking carriage supporting inking units 906*/906*a/910*/915* and selective inking cylinders 98** (fifth embodiment of FIG. 7**)

54 stationary machine frame supporting impression cylinder 7, plate cylinder 8 and chablon cylinders 99* (second embodiment of FIGS. 4*a*-4*b*)

55 inking carriage supporting inking units 96*/96*a**/97* and selective inking cylinders 98* (second embodiment of FIGS. 4***a*-4*b*)

90 (five) inking devices (including components 91-93) distributed about a portion of the circumference of the ink collecting cylinder 9 (prior art of FIGS. 1-2)

91 duct roller (prior art of FIGS. 1-2)

92 ink application rollers (prior art of FIGS. 1-2)

93 (five) chablon cylinders, each carrying a chablon plate 93*a* (prior art of FIGS. 1-2)

93*a* chablon plate carried by chablon cylinders 93 (prior art of FIGS. 1-2)

93A relief portions of chablon plate 93*a*

95 (five) inking devices (including components 96-98) distributed about a portion of the circumference of the ink collecting cylinder 9 (first embodiment of FIGS. 3*a*-3*c*)

96 duct roller (part of ink fountain—first embodiment of FIGS. 3*a*-3*c*)

96*a* ink fountain blade cooperating with duct roller 96 (first embodiment of FIGS. 3*a*-3*c*)

97 ink application rollers (first embodiment of FIGS. 3*a*-3*c*)

98 (five) selective inking cylinders, each carrying a selective inking plate 90*a* (first and fourth embodiments of FIGS. 3*a*-3*c* and 6)

95* (five) inking devices (including components 96*-99*) distributed about a portion of the circumference of the plate cylinder 8 (second embodiment of FIGS. 4*a*-4*b*)

96* duct roller (part of ink fountain—second embodiment of FIGS. 4*a*-4*b*)

96*a ink fountain blade cooperating with duct roller 96* (second embodiment of FIGS. 4***a*-4*b*)

97* ink application rollers (second embodiment of FIGS. 4*a*-4*b*)

98* (five) selective inking cylinders, each carrying a selective inking plate 90*a* (second embodiment of FIGS. 4*a*-4*b*)

99* (five) chablon cylinders, each carrying a chablon plate 99*a* (second embodiment of FIGS. 4*a*-4*b*)

95 (five) inking devices (including components 96**, 96*a*, 98** and 99**) distributed about a portion of the circumference of the ink collecting cylinder 9 (third embodiment of FIGS. 5***a*-5*b*)

96 duct roller (part of ink fountain—third embodiment of FIGS. 5***a*-5*b*)

96*a*** ink fountain blade cooperating with duct roller 96** (third embodiment of FIGS. 5***a*-5*b*)

98 (five) selective inking cylinders, each carrying a selective inking plate 90***a* (third and fifth embodiments of FIGS. 5*a*-5*b* and 7)

99 (five) chablon cylinders, each carrying a chablon plate 99***a* (third and fifth embodiments of FIGS. 5*a*-5*b* and 7)

905 (five) inking devices (including components 906, 906*a*, 910, 915 and 98) distributed about a portion of the circumference of the ink collecting cylinder 9 (fourth embodiment of FIG. 6)

906 duct roller (part of ink fountain—fourth embodiment of FIG. 6)

906*a* ink fountain blade cooperating with duct roller 906 (fourth embodiment of FIG. 6)

910 vibrator roller interposed between duct roller 906 and first ink transfer roller 915*a* (fourth embodiment of FIG. 6)

915 ink transfer rollers (fourth embodiment of FIG. 6)

915*a* first ink transfer roller amongst ink transfer rollers 915 that receives ink from vibrator roller 910 (fourth embodiment of FIG. 6)

905* (five) inking devices (including components 906*, 906*a**, 910*, 915*, 98** and 99**) distributed about a portion of the circumference of the ink collecting cylinder 9 (fifth embodiment of FIG. 7**)

906* duct roller (part of ink fountain—fifth embodiment of FIG. 7)

906*a** ink fountain blade cooperating with duct roller 906* (fifth embodiment of FIG. 7**)

910* vibrator roller interposed between duct roller 906* and first ink transfer roller 915*a (fifth embodiment of FIG. 7**)

915* ink transfer rollers (fifth embodiment of FIG. 7)

915*a first ink transfer roller amongst ink transfer rollers 915* that receives ink from vibrator roller 910* (fifth embodiment of FIG. 7**)

90*a* selective inking plate carried by selective inking cylinders 98, 98*, resp. 98 (first to fifth embodiments of FIGS. 3***a*-3*c* to 7)

900 coating of selective inking plate 90a (in particular ink-repellent coating) that is structured to exhibit ink-repellent portions 910 and ink-accepting portions 920

910 ink-repellent portions of selective inking plate 90*a* (e.g. non-ablated portions of ink-repellent coating 900)

920 ink-accepting portions of selective inking plate 90a (e.g. ablated portions of ink-repellent coating 900—preferably by laser ablation)/locations corresponding to engraved areas of the intaglio printing mediums/plates 8*a* -*c*

99*a* chablon plate carried by chablon cylinders 99*, resp. 99 (second, third and fifth embodiments of FIGS. 4***a*-4*b*, 5*a*-5*b* and 7)

99A relief portions of chablon plate 99*a*

The invention claimed is:

1. An inking system for inking an intaglio printing cylinder of an intaglio printing press, the intaglio printing cylinder carrying one or more intaglio printing mediums, the inking system comprising:

an ink collecting cylinder designed to cooperate with the intaglio printing cylinder and to collect ink patterns from a plurality of inking devices that are distributed about a portion of the circumference of the ink collecting cylinder, wherein at least one of the inking devices comprises a selective inking cylinder cooperating with the ink collecting cylinder and carrying a selective inking plate, the selective inking plate being configured to receive ink supplied by an associated inking unit, wherein the selective inking plate comprises a coating that is selectively structured to exhibit ink-repellent portions and perform a selective transfer of ink at locations corresponding to engraved areas of the one or more intaglio printing mediums that are to be inked with the ink supplied by the associated inking unit, wherein the selective inking plate exhibits substantially no relief, and wherein the coating is:

an ink-repellent coating that is formed on top of an ink-accepting layer or base, the ink-repellent coating being selectively removed, to expose the underlying ink-accepting layer or base at the locations where ink is to be selectively transferred.

2. An inking system for inking an intaglio printing cylinder of an intaglio printing press, the intaglio printing cylinder carrying one or more intaglio printing mediums, the inking system comprising a plurality of inking devices that are distributed about a portion of the circumference of the intaglio printing cylinder, each inking device comprising a chablon cylinder cooperating with the intaglio printing cylinder and carrying a chablon plate that receives ink supplied by an associated inking unit, wherein each chablon plate is a relief plate comprising relief portions corresponding to engraved areas of the one or more intaglio printing mediums that are to be inked with the ink supplied by the associated inking unit, and wherein at least one of the inking devices further comprises a selective inking cylinder interposed between the chablon cylinder and the associated inking unit, the selective inking cylinder carrying a selective inking plate comprising a coating that is selectively structured to exhibit ink-repellent portions and perform a selective transfer of ink at locations corresponding to engraved areas of the one or more intaglio printing mediums that are to be inked with the ink supplied by the associated inking unit, wherein the selective inking plate exhibits substantially no relief, and wherein the coating is:

an ink-repellent coating that is formed on top of an ink-accepting layer or base, the ink-repellent coating being selectively removed to expose the underlying ink-accepting layer or base at the locations where ink is to be selectively transferred.

3. An inking system for inking an intaglio printing cylinder of an intaglio printing press, the intaglio printing cylinder carryings one or more intaglio printing mediums, the inking system comprising an ink collecting cylindere designed to cooperate with the intaglio printing cylinder and to collect ink patterns from a plurality of inking devices that are distributed about a portion of the circumference of the ink collecting cylinder, each inking device comprising a chablon cylinder cooperating with the ink collecting cylinder and carrying a chablon plate that receives ink supplied by an associated inking unit, wherein each chablon plate is a relief plate comprising relief portions corresponding to engraved areas of the one or more intaglio printing mediums that are to be inked with the ink supplied by the associated inking unit, and wherein at least one of the inking devices further comprises a selective inking cylinder interposed between the chablon cylinder and the associated inking unit, the selective inking cylinder carrying a selective inking plate comprising a coating that is selectively structured to exhibit ink-repellent portions and perform selective transfer of ink at locations corresponding to engraved areas of the one or more intaglio printing mediums that are to be inked with the ink supplied by the associated inking unit, wherein the selective inking plate exhibits substantially no relief, and wherein the coating is:

an ink-repellent coating that is formed on top of an ink-accepting layer or base, which ink-repellent coating is selectively removed to expose the underlying ink-accepting layer or base at the locations where ink is to be selectively transferred.

4. The inking system as defined in claim 1, wherein the inking unit supplying ink to the selective inking plate is designed as a short inking unit comprising an ink duct with a duct roller inking the selective inking plate via a pair of ink application rollers.

5. The inking system as defined in claim 3, wherein the inking unit is designed as a short inking unit comprising an ink duct with a duct roller inking the selective inking plate, wherein the duct roller is provided with engravings corresponding to engraved areas of the one or more intaglio printing mediums that are to be inked with the ink supplied by the inking unit.

6. The inking system as defined in claim 1, wherein the inking unit is designed as a long inking unit comprising an ink duct with a duct roller inking the selective inking plate via a plurality of ink transfer rollers.

7. The inking system as defined in claim 6, wherein the inking unit further comprises a vibrator roller interposed between the duct roller and a first one of the ink transfer rollers.

8. The inking system as defined in claim 4, wherein the ink duct is designed as an ink fountain with an ink fountain blade cooperating with the duct roller.

9. An intaglio printing press comprising an inking system as defined in claim 1.

10. An intaglio printing press comprising an inking system as defined in claim 1, wherein the inking unit is located and supported in an inking carriage that is retractable away from the ink collecting cylinder during maintenance operations.

11. The intaglio printing press as defined in claim 10, wherein the ink collecting cylinder is located and supported, together with each selective inking cylinder, in an intermediate carriage that is retractable away from the intaglio printing cylinder during maintenance operations.

12. An intaglio printing press comprising an inking system as defined in claim 2, wherein the inking units are located and supported, together with each selective inking cylinder, in an inking carriage that is retractable away from the intaglio printing cylinder during maintenance operations.

13. An intaglio printing press comprising an inking system as defined in claim 3, wherein the inking units are located and supported, together with each selective inking cylinder, in an inking carriage that is retractable away from the ink collecting cylinder during maintenance operations.

14. The intaglio printing press as defined in claim 13, wherein the ink collecting cylinder is located and supported, together with the chablon cylinders, in an intermediate carriage that is retractable away from the intaglio printing cylinder during maintenance operations.

15. A process of inking an intaglio printing cylinder of an intaglio printing press, the intaglio printing cylinder carrying one or more intaglio printing mediums, the process including inking the one or more intaglio printing mediums by way of a plurality of inking devices, wherein the process includes a selective transfer of ink to the one or more intaglio printing mediums by way of a selective inking cylinder provided in at least one of the inking devices, the selective inking cylinder carrying a selective inking plate receiving ink supplied by an associated inking unit, wherein the selective inking plate comprises a coating that is selectively structured to exhibit ink-repellent portions and perform selective transfer of ink at locations corresponding to engraved areas of the one or more intaglio printing mediums that are to be inked with the ink supplied by the associated inking unit, wherein the selective transfer of ink is performed indirectly from the selective inking cylinder to the one or more intaglio printing mediums via an ink collecting cylinder and/or via a chablon cylinder carrying a chablon plate comprising relief portions corresponding to engraved areas of the one or more intaglio printing mediums that are to be inked with the ink supplied by the associated inking unit, wherein the selective inking plate exhibits substantially no relief, and wherein the coating is:

an ink-repellent coating that is formed on top of an ink-accepting layer or base, which ink-repellent coating is selectively removed to expose the underlying ink-accepting layer or base at the locations where ink is to be selectively transferred.

16. The inking system as defined in claim 1, wherein the ink-repellent coating is laser-ablated to expose the underlying ink-accepting layer or base at the locations where ink is to be selectively transferred.

17. An inking system for inking an intaglio printing cylinder of an intaglio printing press, the intaglio printing cylinder carrying one or more intaglio printing mediums, the inking system comprising:

an ink collecting cylinder designed to ooperate with the intaglio printing cylinder and to collect ink patterns from a plurality of inking devices that are distributed about a portion of the circumference of the ink collecting cylinder, wherein at least one of the inking devices comprises a selective inking cylinder cooperating with the ink collecting cylinder and carrying a selective inking plate, the selective inking plate being configured to receive ink supplied by an associated inking unit, wherein the selective inking plate comprises a coating that is selectively structured to exhibit ink-repellent portions and perform selective transfer of ink at locations corresponding to engraved areas of the one or more intaglio printing mediums that are to be inked with the ink supplied by the associated inking unit, wherein the selective inking plate exhibits substantially no relief, and wherein the coating is an ink-accepting coating that is formed on top of an ink-repellent layer or base, the ink-accepting coating being selectively removed to expose the underlying ink- repellent layer or base and form the ink-repellent portions outside of the locations where ink is to be selectively transferred.

18. The inking system as defined in claim 17, wherein the ink-accepting coating is laser-ablated to epose the underlying ink-repellent layer or base and form the ink-repellent portions outside of the locations where ink is to be selectively transferred.

19. The inking system as defined in claim 2, wherein the ink-repellent coating is laser-ablated to epose the underlying ink-accepting layer or base at the locations where ink is to be selectively transferred.

20. An inking system for inking an intaglio printing cylinder of an intaglio printing press, the intaglio printing cylinder carrying one or more intaglio printing mediums, the inking system comprinsing a plurality of inking devices that are distributed about a portion of the circumference of the intaglio printing cylinder, each inking device comprising a chablon cylinder cooperating with the intaglio printing cylinder and carrying a chablon plate that receives ink supplied by an associated inking unit, wherein each chablon plate is a relief plate comprising relief portions corresponding to engraved areas of the one or more intaglio printing mediums that are to be inked with the ink supplied by the associated inking unit, and wherein at least one of the inking devices further comprises a selective inking cylinder interposed between the chablon cylinder and the associated inking unit, the selective inking cylinder carryuing a selective inking plate comprising a coating that is selectively structured to exhibit ink-repellent portions and perform a selective transfer of ink at locations corresponding to engraved areas of the one or more intaglio printing mediums that are to be inked with the ink supplied by the associated inking unit, wherein the selective inking plate exhibits substantially no relief, and wherein the coating is an ink-accepting coating that is formed on top of an ink-repellant layer or base, the ink-repellent coating being selectively removed to expose the underlying ink-repellent layer or base and form the ink-repellent portions outside of the locations where ink is to be selectively transferred.

21. The inking system as defined in claim 20, wherein the ink-accepting coating is laser-ablated to expose the underlying ink-repellent layer or base and form the ink-repellent portions outside of the locations where ink is to be selectively transferred.

22. The inking system as defined in claim 3, wherein the ink-repellent coating is laser-ablated to expose the underlhying ink-accepting layer or base at the locations where ink is to be selectively transferred.

23. An inking system for inking an intagliio printing cylinder of an intaglio printing press, the intaglio printing cylinder carrying one or more intaglio printing mediums, the inking system comprising an ink collecting cylinder designed to cooperate with the intaglio printing cylinder and to collect ink patters from a plurality of inking devices that are distributed about a portion of the circumference of the ink collecting cylinder, each inking device comprising a chablon cylinder cooperating with the ink collecting cylinder and carrying a chablon plate that receives ink supplied by an associated inking unit, wherein each chablon plate is a relief plate comprising relief portions correspinding to engraved areas of the one or more intaglio printing mediums that are to be inked with the ink supplied by the associated inking unit, and wherein at least one of the inking devices further comprises a selective inking cylinder interposed between the chablon cylinder and the associated inking unit, the selective inking cylinder carrying a selective inking plate comprising a coating that is selectively structured to exhibit ink-repellent portions and perform selective transfer of ink at locations corresponding to engraved areas of the one or more intaglio printing mediums that are to be inked with the ink supplied by the associated inking unit, wherein the selective inking plate exhibits substantially no relief, and wherein the coating is an ink-accepting coating that is formed on top of an ink-repellent layer or base, the ink-accepting coating being selectively removed to expose the underlying ink-repellent layer or base and form the ink-repellent portions outside of the locations where ink it to be selectively transferred.

24. The inking system as defined in claim 23, wherein the ink-accepting coating is laser-ablated to expose the underlying ink-repellent layer or base and form the ink-repellent portions outside of the locations where ink is to be selectively transferred.

25. The inking system as defined in claim 15, wherein the ink-repellent coating is laser-ablated to expose the underlying ink-accepting layer or base at the locations where ink it to be selectively transferred.

26. A process of inking an intaglio printing cylinder of an intaglio printing press, the intaglio printing cylinder carrying one or more intaglio printing mediums, the process including inking the one or more intaglio printing mediums by way of a plurality of inking devices, wherein the process includes a selective transfer of ink to the one or more intaglio printing mediums by way of a selective inking cylinder provided in at least one of the inking devices, the selective inking cylinder carryiing a selective inking plate receiving ink supplied by an associated inking unit, wherein the selective inking plate comprises a coating that is selectively structured to exhibit ink-repellent portions and perform selective transfer of ink at locations corresponding to engraved areas of the one or more intaglio printing mediums that are to be inked with the ink supplied by the associated inking unit, wherein the selective transfer of ink is performed indirectly from the selective inking cylinder to the one or more intaglio printing mediums via an ink collecting cylinder and/or via a chablon cylinder carrying a chablon plate comprising relief portions corresponding to engraved areas of the one or more intaglio printing mediums that are to be inked with the ink supplied by the associated inking unit, wherein the selective inking plate exhibits substantially no relief, and wherein the coating is an ink-accepting coating that is formed on top of ink-repellent layer or base, the ink-accepting coating being selectively removed to expose the underlying ink-repellent layer or base and form the ink-repellent portions outside of the locations where ink is to be selectively transferred.

27. The inking system as defined in claim 26, wherein the ink-accepting coating is laser-ablated to expose the underlying ink-repellent layer or base and form the ink-repellent portions outside of the locations where ink is to be selectively transferred.

* * * * *